US011476020B2

(12) United States Patent
Sakuma et al.

(10) Patent No.: US 11,476,020 B2
(45) Date of Patent: Oct. 18, 2022

(54) RARE EARTH MAGNET AND PRODUCTION METHOD THEREOF

(71) Applicants: TOYOTA JIDOSHA KABUSHIKI KAISHA, Toyota (JP); TOHOKU UNIVERSITY, Sendai (JP)

(72) Inventors: Noritsugu Sakuma, Mishima (JP); Tetsuya Shoji, Susono (JP); Kazuaki Haga, Toyota (JP); Satoshi Sugimoto, Sendai (JP); Masashi Matsuura, Sendai (JP)

(73) Assignees: TOYOTA JIDOSHA KABUSHIKI KAISHA, Toyota (JP); TOHOKU UNIVERSITY, Sendai (JP)

( * ) Notice: Subject to any disclaimer, the term of this patent is extended or adjusted under 35 U.S.C. 154(b) by 422 days.

(21) Appl. No.: 16/013,101

(22) Filed: Jun. 20, 2018

(65) Prior Publication Data

US 2019/0006068 A1 Jan. 3, 2019

(30) Foreign Application Priority Data

Jun. 30, 2017 (JP) ..... JP2017-129658
Jan. 30, 2018 (JP) ..... JP2018-014161

(51) Int. Cl.
*H01F 1/057* (2006.01)
*H01F 1/055* (2006.01)
(Continued)

(52) U.S. Cl.
CPC ..... *H01F 1/0577* (2013.01); *B22F 1/145* (2022.01); *B22F 1/17* (2022.01); *C22C 38/005* (2013.01);
(Continued)

(58) Field of Classification Search
CPC ..... H01F 1/0577; H01F 1/059; C22C 38/001; C22C 38/005
See application file for complete search history.

(56) References Cited

U.S. PATENT DOCUMENTS 5,164,104 A * 11/1992 Kobayashi ..... C04B 35/58042 252/62.53
2014/0242267 A1* 8/2014 Shoji ..... H01F 1/055 427/127
(Continued)

FOREIGN PATENT DOCUMENTS

JP H10-41116 A 2/1998
JP 2005223263 A * 8/2005
(Continued)

OTHER PUBLICATIONS

Matsuura et al., "High coercive Zn-bonded Sm—Fe—N magnets prepared using fine Zn particles with low oxygen content", Dec. 2017, Journal of Magnetism and Magnetic Materials 452, p. 243-248 (Year: 2017).*
(Continued)

*Primary Examiner* — Nicholas A Wang
(74) *Attorney, Agent, or Firm* — Oliff PLC

(57) ABSTRACT

To provide a rare earth magnet having excellent coercive force and a production method thereof. A rare earth magnet, wherein the rare earth magnet comprises a magnetic phase containing Sm, Fe, and N, a Zn phase present around the magnetic phase, and an intermediate phase present between the magnetic phase and the Zn phase, wherein the intermediate phase contains Zn and the oxygen content of the intermediate phase is higher than the oxygen content of the Zn phase; and a method for producing a rare earth magnet, including mixing a magnetic raw material powder having an oxygen content of 1.0 mass % or less and an improving
(Continued)

agent powder containing metallic Zn and/or a Zn alloy, and heat-treating the mixed powder.

15 Claims, 18 Drawing Sheets

(51) Int. Cl.

| | |
|---|---|
| ***C22C 38/00*** | (2006.01) |
| ***H01F 1/059*** | (2006.01) |
| ***B22F 1/17*** | (2022.01) |
| ***B22F 1/145*** | (2022.01) |
| ***H01F 41/02*** | (2006.01) |

(52) U.S. Cl.
CPC ..... *H01F 1/059* (2013.01); *H01F 1/0552* (2013.01); *H01F 1/0557* (2013.01); *H01F 41/0266* (2013.01); *H01F 41/0293* (2013.01); *B22F 2998/10* (2013.01); *B22F 2999/00* (2013.01); *C22C 38/001* (2013.01)

(56) References Cited

U.S. PATENT DOCUMENTS

| | | | | |
|---|---|---|---|---|
| 2016/0027563 | A1 | 1/2016 | Shimizu | |
| 2018/0226180 | A1* | 8/2018 | Kawashita | H01F 1/0533 |
| 2019/0333661 | A1* | 10/2019 | Takagi | H01F 1/065 |

FOREIGN PATENT DOCUMENTS

| | | | |
|---|---|---|---|
| JP | 2015-201628 | A | 11/2015 |
| JP | 2015201628 | * | 11/2015 |
| JP | 2015201628 | A * | 11/2015 |
| JP | 2017046463 | * | 3/2017 |
| WO | 2014/156181 | A1 | 10/2014 |
| WO | 2017/033266 | A1 | 3/2017 |

OTHER PUBLICATIONS

Kawashita et al., JP2015201628A, machine-generated English language text (Year: 2020).*

Ishikawa et al., JP2005223263A, machine-generated English language text (Year: 2020).*

Takagi et al. "Microstructural behavior on particle surfaces and interfaces in Sm2Fe17N3 powder compacts during low-temperature sintering", Journal of Magnetism and Magnetic Materials 324, p. 2336-2341 (Year: 2012).*

Matsuura, Masashi, et al., "High coercive Zn-bonded Sm—Fe—N magnets prepared using fine Zn particles with low oxygen content", Journal of Magnetism and Magnetic Materials, vol. 452, pp. 243-248, 2018.

* cited by examiner

RARE EARTH MAGNET AND PRODUCTION METHOD THEREOF

TECHNICAL FIELD

The present disclosure relates to a rare earth magnet, particularly, a rare earth magnet containing Sm, Fe and N, and a production method thereof.

BACKGROUND ART

As a high-performance rare earth magnet, an Sm—Co-based rare earth magnet and an Nd—Fe—B-based rare earth magnet have been used, but a rare earth magnet other than these has been studied in recent years.

For example, a rare earth magnet containing Sm, Fe and N (hereinafter, sometimes referred to as "Sm—Fe—N-based rare earth magnet") has been studied. In the Sm—Fe—N-based rare earth magnet, N is considered to form an interstitial solid solution in an Sm—Fe crystal. The Sm—Fe—N-based rare earth magnet is known as a rare earth magnet having a high Curie temperature and excellent magnetic properties at high temperature. The high temperature as used herein indicates a temperature of 150 to 300° C.

Improvements of the Sm—Fe—N-based rare earth magnet are also being studied. For example, Patent Document 1 discloses an attempt to enhance the coercive force by mixing a magnetic powder containing Sm, Fe and N with a metallic Zn powder, molding the mixture, and heat-treating the molded body.

RELATED ART

Patent Document

[Patent Document 1] Japanese Unexamined Patent Publication No. 2015-201628

SUMMARY OF THE INVENTION

Problems to be Solved by the Invention

As for the rare earth magnet disclosed in Patent Document 1, the coercive force may not be sufficiently enhanced. That is, the present inventors have found a problem that in the Sm—Fe—N-based rare earth magnet, there is room for improvement in enhancing the coercive force.

The present disclosure has been made to solve the above-described problem and aims at providing an Sm—Fe—N-based rare earth magnet having excellent coercive force and a production method thereof.

Means to Solve the Problems

The present inventors have continued intensive studies to attain the object above and have accomplished the rare earth magnet of the present disclosure and the production method thereof. The gist thereof is as follows.

(1) A rare earth magnet, wherein the rare earth magnet comprises a magnetic phase containing Sm, Fe, and N, a Zn phase present around the magnetic phase, and an intermediate phase present between the magnetic phase and the Zn phase, wherein the intermediate phase contains Zn, and wherein the oxygen content of the intermediate phase is higher than the oxygen content of the Zn phase.

(2) The rare earth magnet according to item (1), wherein the oxygen content of the intermediate phase is from 1.5 to 20.0 times higher than the oxygen content of the Zn phase.

(3) The rare earth magnet according to item (1) or (2), wherein an $Sm_2O_3$ phase having an Ia-3 crystal structure is formed in the intermediate phase.

(4) The rare earth magnet according to any one of items (1) to (3), wherein the magnetic phase contains a phase represented by $(Sm_{(1-i)}R_i)_2(Fe_{(1-j)}Co_j)_{17}N_h$ (wherein R is one or more members selected from rare earth elements other than Sm, and Y and Zr, i is from 0 to 0.50, j is from 0 to 0.52, and h is from 1.5 to 4.5).

(5) The rare earth magnet according to any one of items (1) to (4), wherein the texture parameter α represented by the formula: $H_c=\alpha\cdot H_a-N_{eff}\cdot M_s$ (He is the coercive force, $H_a$ is the anisotropic magnetic field, $M_s$ is the saturation magnetization, and $N_{eff}$ is the self-demagnetizing field coefficient) is from 0.07 to 0.55.

(6) The rare earth magnet according to item (5), wherein the texture parameter ca is from 0.11 to 0.55.

(7) The rare earth magnet according to any one of items (1) to (6), wherein the oxygen content relative to the whole rare earth magnet is from 1.55 to 3.00 mass %.

(8) A method for producing a rare earth magnet, including:

mixing a magnetic raw material powder containing Sm, Fe, and N with an improving agent powder containing at least either one of metallic Zn and a Zn alloy such that the content of a Zn component in the improving agent powder is from 1 to 20 mass % relative to the total of the magnetic raw material powder and the improving agent powder, thereby obtaining a mixed powder, and heat-treating the mixed powder at T−30° C. or more and 500° C. or less, denoting T° C. as the lowest melting point out of the melting points of the metallic Zn or Zn alloy contained in the mixed powder, and wherein the oxygen content in the improving agent powder is 1.0 mass % or less relative to the whole improving agent powder.

(9) The method according to item (8), wherein the magnetic raw material powder contains a magnetic phase represented by $(Sm_{(1-i)}R_i)_2(Fe_{(1-j)}Co_j)_{17}N_h$ (wherein R is one or more members selected from rare earth elements other than Sm, and Y and Zr, i is from 0 to 0.50, j is from 0 to 0.52, and h is from 1.5 to 4.5).

(10) The method according to item (8) or (9), wherein the mixing and heat treatment are performed at the same time.

(11) The method according to item (8) or (9), further including compacting the mixed powder before the heat treatment.

(12) The method according to item (11), wherein the compacting is performed in a magnetic field.

(13) The method according to any one of items (8) to (12), wherein with respect to a unit particle of the improving agent powder, denoting C (mass %) as the oxygen content and denoting S ($cm^{-1}$) as the ratio of the surface area to the volume, the value of S/C ($cm^{-1}\cdot$mass $\%^{-1}$) is 90,000 or more.

Effects of the Invention

According to the rare earth magnet of the present disclosure, oxygen in the oxidized phase covering the magnetic phase is diffused into the Zn phase to enrich oxygen in the intermediate phase between the magnetic phase and the Zn phase, and an Sm—Fe—N-based rare earth magnet having excellent coercive force can thereby be provided.

According to the production method of a rare earth magnet of the present disclosure, a heat treatment is performed using an improving agent powder with a small oxygen content in order for oxygen in the magnetic phase to diffuse into the Zn phase in the improving agent powder and enrich oxygen in the intermediate phase, and the production method of an Sm—Fe—N-based rare earth magnet having excellent coercive force can thereby be provided.

MODE FOR CARRYING OUT THE INVENTION

The embodiments of the rare earth magnet of the present disclosure and the production method thereof are described in detail below. Incidentally, the embodiments set forth below should not be construed to limit the rare earth magnet of the present disclosure and the production method thereof.

The rare earth magnet of the present disclosure is obtained by heat-treating a mixed powder of a magnetic raw material powder containing Sm, Fe and N, and an improving agent powder containing at least either one of metallic Zn and a Zn alloy, at a predetermined temperature.

Figure 1A:
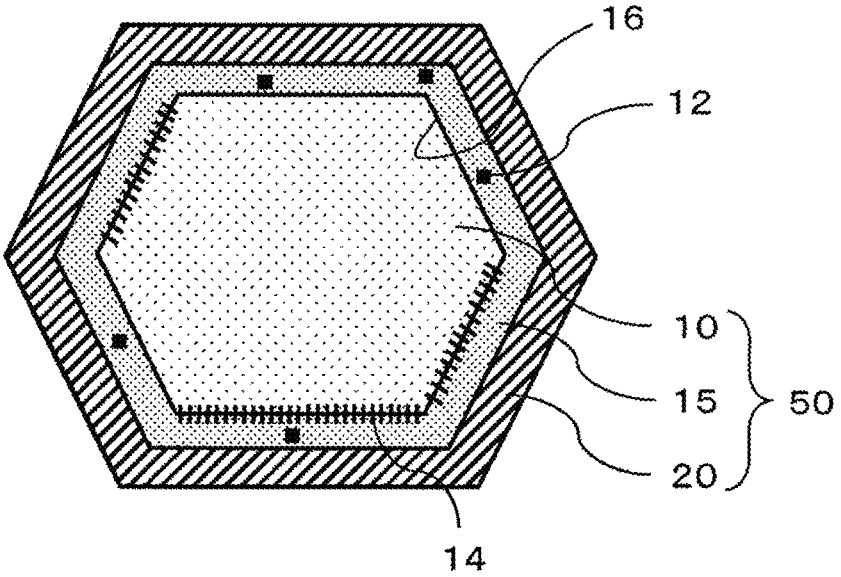
FIG. 1A depicts the texture before heat-treating the mixed powder.
Figure 1B:
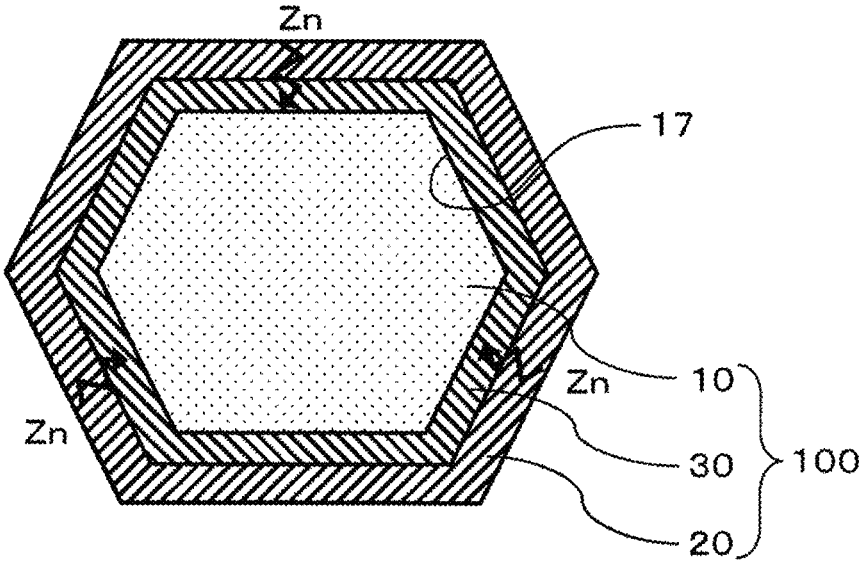
FIG. 1B depicts the texture after heat-treating the mixed powder.

FIGS. 1A and 1B are diagrams schematically illustrating the texture in one embodiment of the rare earth magnet of the present disclosure. FIG. 1A depicts the texture before heat-treating the mixed powder, and FIG. 1B depicts the texture after heat-treating the mixed powder.

The particles of the improving agent powder are softer than the particles of the magnetic raw material powder, and therefore when the magnetic raw material powder and the improving agent powder are mixed, the surface of the particles of the magnetic raw material powder are coated with a constituent element of the improving agent powder. In addition, since the magnetic raw material is easy to be oxidized, the surface of the particles of the magnetic raw material powder are covered by an oxidized phase. From these facts, as illustrated in FIG. 1A, the particles 50 of the mixed powder have a magnetic phases 10, an oxidized phase 15, and a Zn phase 20. The magnetic phase 10 is covered by the oxidized phase 15, and the surface of the oxidized phase 15 is coated with the Zn phase 20.

In the oxidized phase 15, a fine α-Fe phase 12 is formed of Fe not constituting the magnetic phase 10. In addition, since a crystal of the magnetic phase 10 and a crystal of the oxidized phase 15 are not matched at the interface 16 between the magnetic phase 10 and the oxidized phase 15, a mismatched interface 14 is formed, and a disorder occurs at the interface 16. The α-Fe phase 12 and the mismatched interface 14 serve as a nucleation site for magnetization reversal, and therefore the coercive force decreases.

The present inventors have found that when the oxygen content in the improving agent powder is 1.0 mass % or less relative to the whole improving agent powder, the nucleation site for magnetization reversal can be eliminated. Furthermore, the present inventors have found that the rare earth magnet 100 of the present disclosure after heat-treating the mixed powder is in the following state. That is, as illustrated in FIG. 1B, the rare earth magnet 100 of the present disclosure has a magnetic phase 10, a Zn phase 20, and an intermediate phase 30. The intermediate phase 30 contains Zn, the oxygen content of the intermediate phase 30 is higher than the oxygen content of the Zn phase 20, and oxygen is enriched in the intermediate layer 30.

Although not bound by theory, it is believed that the reason why the intermediate phase 30 contains Zn and the oxygen content of the intermediate phase 30 is higher than the oxygen content of the Zn phase 20 and oxygen is enriched in the intermediate layer 30 is as follows.

As described above, the nucleation site for magnetization reversal includes an α-Fe phase 12 and a mismatched interface 14, etc. The α-Fe phase 12 is derived from Fe not constituting the magnetic phase 10 and is present in the oxidized phase 15, and the oxidized phase 15 forms a mismatched interface 14 with the magnetic phase 10.

Both the α-Fe phase 12 and the mismatched interface 14 are unstable, and Zn in the Zn phase 20 has strong affinity for oxygen. Accordingly, when the particles 50 of the mixed powder are heat-treated, oxygen in the oxidized phase 15 combines with Zn in the Zn phase 20 and forms an intermediate phase 30. Consequently, the oxidized phase 15 disappears and as a result, the α-Fe phase 12 present in the oxidized phase 15 disappears, and the unmatched interface 14 between the magnetic phase 10 and the oxidized phase 15 also disappears. Then, Ia-3-type $Sm_2O_3$ is formed in the intermediate phase 30. Although not bound by theory, compared with the case where hep-type $Sm_2O_3$ is formed, when Ia-3-type $Sm_2O_3$ is formed, a facet interface 17 is likely to be formed between the magnetic phase 10 and the intermediate phase 30, and crystallinity of the intermediate phase is enhanced, contributing to the increase in the coercive force.

The intermediate phase 30 is formed by combining Zn and oxygen, and therefore the intermediate phase 30 contains Zn. Containing Zn in the intermediate phase 30 means that the intermediate phase 30 are derived from the particles 50 of the mixed powder before heat treatment.

Formation of the intermediate phase 30 occurs when the oxygen content of the Zn phase 20 before heat treatment is low, and occurs near the contact face of the Zn phase 20 and the oxidized phase 15. Accordingly, oxygen is enriched in the intermediate phase 30. For allowing such an intermediate phase 30 to be formed by heat treatment, the oxygen content in the improving agent powder is set at 1.0 mass % or less relative to the whole improving agent powder at the time of preparation of a mixed powder of a magnetic raw material powder and an improving agent powder. By setting the oxygen content in this way, as illustrated in FIG. 1B, Zn in the Zn phase 20 contributes to the formation of the intermediate phase 30 at the time of heat treatment.

The configuration requirements of the rare earth magnet of the present disclosure and the production method thereof accomplished based on the knowledge, etc. above are described below.

Rare Earth Magnet

As illustrated in FIG. 1B, the rare earth magnet 100 of the present disclosure comprises a magnetic phase 10, a Zn phase 20, and an intermediate phase 30. The form of the rare earth magnet 100 is not particularly limited. The form of the rare earth magnet 100 includes a powder, a bonded magnet, a sintered magnet, etc.

FIG. 1B is a diagram schematically illustrating the texture in one embodiment of the rare earth magnet of the present disclosure, and this is one example of the texture when the rare earth magnet is a powder. A bonded magnet may also be formed using a powder having a texture illustrated in FIG. 1B.

Figure 2:
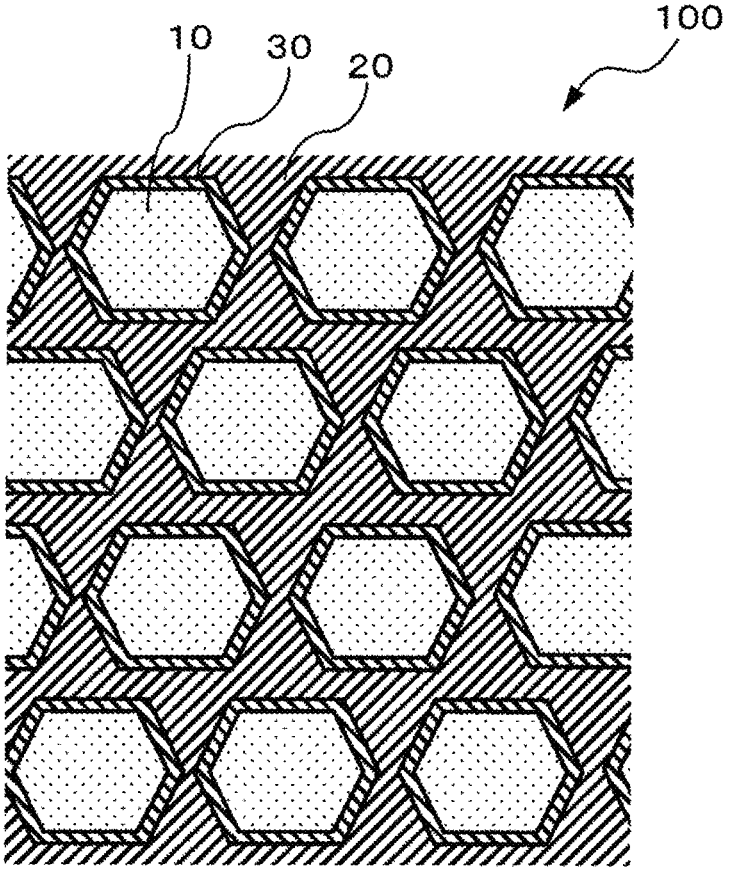
FIG. 2 is a diagram schematically illustrating the texture in another embodiment of the rare earth magnet of the present disclosure.

FIG. 2 is a diagram schematically illustrating the texture in another embodiment of the rare earth magnet of the present disclosure. The texture of FIG. 2 is one example of the texture of a sintered magnet obtained by sintering (including liquid-phase sintering) a powder having a texture illustrated in FIG. 1B. In the case where the rare earth magnet 100 is a sintered magnet, as illustrated in FIG. 2, particles composed of a magnetic phase 10 and an intermediate phase 30 may be connected by a Zn phase 20, but the configuration is not limited thereto. As another embodiment when the rare earth magnet 100 is a sintered magnet, there is, for example, an embodiment where elements constituting the Zn phase 20 and the intermediate phase 30 are mutually diffused to make the Zn phase 20 in FIG. 2 integral with the intermediate phase 30.

The overall composition of the rare earth magnet 100 is appropriately determined such that each of the magnetic phase 10, the Zn phase 20 and the intermediate phase 30 has the later-described composition, texture, form, etc. The composition of the rare earth magnet 100 is, for example, represented by $Sm_xR_yFe_{(100-x-y-z-w-p-q)}Co_zM^1_wN_pO_q \cdot (Zn_{(1-s-t)}M^2_sO_t)_r$. R is one or more members selected from rare earth elements other than Sm, and Y and Zr. $M^1$ represents one or more members selected from Ga, Ti, Cr, Zn, Mn, V, Mo, W, Si, Re, Cu, Al, Ca, B, Ni, and C, and an unavoidable impurity element. $M^2$ represents one or more members selected from Sn, Mg, and Al, and an unavoidable impurity element. x, y, z, w, p, q, and r are at %, and s and t are a ratio (molar ratio).

In the present description, the rare earth element indicates Sc, La, Ce, Pr, Nd, Pm, Sm, Eu, Gd, Tb, Dy, Ho, Er, Tm, Yb, and Lu.

In the composition represented by $Sm_xR_yFe_{(100-x-y-z-w-p-q)}Co_zM^1_wN_pO_q \cdot (Zn_{(1-s-t)}M^2_sO_t)_r$, $Sm_xR_yFe_{(100-x-y-z-w-p-q)}Co_zM^1_wN_pO_q$ is derived from the magnetic raw material powder, and $(Zn_{(1-s-t)}M^2_sO_t)_r$ is derived from the improving agent powder.

Sm is one of main elements of the rare earth magnet 100, and the content thereof is appropriately determined such that the magnetic phase 10 has the later-described composition, etc. The content x of Sm may be, for example, 4.5 at % or more, 5.0 at % or more, or 5.5 at % or more, and may be 10.0 at % or less, 9.0 at % or less, or 8.0 at % or less.

The rare earth element contained in the rare earth magnet 100 is mainly Sm, but as long as the effects of the rare earth magnet of the present disclosure and the production method are not inhibited, the magnetic phase 10 may contain R. R is, as described above, one or more members selected from rare earth elements other than Sm, and Y and Zr. The content y of R may be, for example, 0 at % or more, 0.5 at % or more, or 1.0 at % or more, and may be 5.0 at % or less, 4.0 at % or less, or 3.0 at % or less.

Fe is one of main elements of the rare earth magnet 100 and forms the magnetic phase 10 in cooperation with Sm and N. The content thereof is the remainder of Sm, R, Co, $M^1$, N, and O in the formula $Sm_xR_yFe_{(100-x-y-z-w-p-q)}Co_zM^1_wN_pO_q$.

Part of Fe may be substituted by Co. When the rare earth magnet 100 contains Co, the Curie temperature of the rare earth magnet 100 is raised. The content z of Co may be, for example, 0 at % or more, 5 at % or more, or 10 at % or more, and may be 31 at % or less, 20 at % or less, or 15 at % or less.

$M^1$ represents an element added for enhancing specific properties, for example, heat resistance and corrosion resistance, within the range not compromising the magnetic properties of the rare earth magnet 100, and an unavoidable impurity element. The element for enhancing specific properties is one or more members selected from Ga, Ti, Cr, Zn, Mn, V, Mo, W, Si, Re, Cu, Al, Ca, B, Ni, and C. The unavoidable impurity element indicates an impurity that is unavoidably contained or causes a significant rise in the production cost for avoiding its inclusion, such as impurity contained in a raw material of the rare earth magnet 100. The content w of $M^1$ may be, for example, 0 at % or more, 0.5 at % or more, or 1.0 at % or more, and may be 3.0 at % or less, 2.5 at % or less, or 2.0 at % or less.

N is one of main elements of the rare earth magnet 100, and the content thereof is appropriately determined such that the magnetic phase 10 has the later-described composition, etc. The content p of N may be, for example, 11.6 at % or more, 12.5 at % or more, or 13.0 at % or more, and may be 15.6 at % or less, 14.5 at % or less, or 14.0 at % or less.

Zn eliminates the nucleation site for magnetization reversal in the mixed powder and enhances the coercive force of the rare earth magnet 100. Zn in the improving agent powder remains in the rare earth magnet 100. In regard to the rare earth magnet 100, Zn in such an amount as not reducing the magnetization while enhancing the coercive force is caused to remain (contained) in the rare earth magnet 100. From the viewpoint of eliminating the nucleation site for magnetization switching, the content of Zn is preferably 0.89 at % (1 mass %) or more, more preferably 2.60 at % (3 mass %) or more, still more preferably 4.30 at % (5 mass %) or more, relative to the whole rare earth magnet 100. On the other hand, from the viewpoint of not reducing the magnetization, the content of Zn is preferably 15.20 at % (20 mass %) or less, more preferably 11.90 at % (15 mass %) or less, still more preferably 8.20 at % (10 mass %) or less, relative to the whole rare earth magnet 100. The content of Zn is represented by (1−s−t)r at % relative to the whole rare earth magnet 100.

$M^2$ is an alloy element when a Zn alloy is used as the improving agent powder. The rare earth magnet 100 is obtained by heat-treating a mixed powder of a magnetic raw material powder and an improving agent powder. $M^2$ represents an element for decreasing the melting initiation temperature of a Zn-$M^2$ alloy to be lower than the melting point of metallic Zn by alloying with Zn, and an unavoidable impurity element. Incidentally, in the present description, metallic Zn means unalloyed Zn.

The element $M^2$ for decreasing the melting initiation temperature of the Zn-$M^2$ alloy to be lower than the melting point of metallic Zn includes an element of forming a eutectic alloy by Zn and $M^2$. Typically, $M^2$ includes Sn, Mg, or Al, and a combination thereof, etc. The element added for enhancing specific properties of the rare earth magnet 100, for example, heat resistance and corrosion resistance, without inhibiting the melting point-lowering action of such an element may also be encompassed by $M^2$. In addition, the unavoidable impurity element indicates an impurity element that is unavoidably contained or causes a significant rise in the production cost for avoiding its inclusion, such as impurity contained in a raw material of the improving agent powder.

The ratio (molar ratio) of Zn and $M^2$ in the improving agent powder may be appropriately determined to make the heat treatment temperature proper. The ratio (molar ratio) s of $M^2$ relative to the whole improving agent powder may be, for example, 0 or more, 0.05 or more, or 0.10 or more, and may be 0.90 or less, 0.80 or less, or 0.70 or less. The improving agent powder may be a metallic Zn powder and at this time, the ratio (molar ratio) s of $M^2$ is 0. In the metallic Zn powder, the content of Zn is not 100 mass %, and the powder is allowed to contain the above-described unavoidable impurity. The acceptable amount of the unavoidable impurity may be 1 mass % or less, 2 mass % or less, or 4 mass % or less, relative to the whole metallic Zn powder. In turn, the Zn content of the metallic Zn powder may be 96 mass % or more, 98 mass %, or 99 mass % or more.

O (oxygen) is derived from the magnetic raw material powder and the improving agent powder and remains (is contained) in the rare earth magnet 100. Oxygen is enriched in the intermediate phase 30, so that even when the oxygen content of the whole rare earth magnet 100 is comparatively high, excellent coercive force can be ensured. The oxygen content relative to the whole rare earth magnet 100 may be, for example, 5.5 at % or more, 6.2 at % or more, or 7.1 at % or more, and may be 10.3 at % or less, 8.7 at % or less, or 7.9 at % or less. Incidentally, the oxygen content relative to the whole rare earth magnet 100 is q+tr at %. When the oxygen content relative to the whole rare earth magnet 100 is converted to mass %, the oxygen content may be 1.55 mass % or more, 1.75 mass % or more, or 2.00 mass % or more, and may be 3.00 mass % or less, 2.50 mass % or less, or 2.25 mass % or less.

Next, each of the magnetic phase 10, the Zn phase 20, and the intermediate phase 30 is described. These phases are described by referring to a case where the form of the rare earth magnet 100 is a powder, but unless otherwise indicated, the same applies to when the form of the rare earth magnet 100 is a bonded magnet or a sintered magnet, etc.

(Magnetic Phase)

The magnetic phase 10 develops the magnetic properties of the rare earth magnet 100. The magnetic phase 10 contains Sm, Fe, and N. As long as the effects of the rare earth magnet of the present disclosure and the production method thereof are not inhibited, the magnetic phase 10 may contain R. R is one or more members selected from rare earth elements except for Sm, and Y and Zr. The magnetic phase 10 expressed by the molar ratio of Sm, R, Fe, Co and N is $(Sm_{(1-i)}R_i)_2(Fe_{(1-j)}Co_j)_{17}N_h$. Here, h is preferably 1.5 or more, more preferably 2.0 or more, still more preferably 2.5 or more, and on the other hand, h is preferably 4.5 or less, more preferably 4.0 or less, still more preferably 3.5 or less. In addition, i may be 0 or more, 0.10 or more, or 0.20 or more, and may be 0.50 or less, 0.40 or less, or 0.30 or less, and j may be 0 or more, 0.10 or more, or 0.20 or more, and may be 0.52 or less, 0.40 or less, or 0.30 or less.

With respect to $(Sm_{(1-i)}R_i)_2(Fe_{(1-j)}Co_j)_{17}N_h$, typically, R is substituted at the position of Sm of $Sm_2(Fe_{(1-j)}Co_j)_{17}N_h$, but the configuration is not limited thereto. For example, part of R may be arranged in an interstitial manner in $Sm_2(Fe_{(1-j)}Co_j)_{17}N_h$.

In addition, with respect to $(Sm_{(1-i)}R_i)_2(Fe_{(1-j)}Co_j)_{17}N_h$, typically, Co is substituted at the position of Fe of $(Sm_{(1-i)}R_i)_2Fe_{17}N_h$, but the configuration is not limited thereto. For example, part of Co may be arranged in an interstitial manner in $(Sm_{(1-i)}R_i)_2Fe_{17}N_h$.

Furthermore, with respect to $(Sm_{(1-i)}R_i)_2(Fe_{(1-j)}Co_j)_{17}N_h$, h may be from 1.5 to 4.5, but typically, the configuration is $(Sm_{(1-i)}R_i)_2(Fe_{(1-j)}Co_j)_{17}N_3$. The content of $(Sm_{(1-i)}R_i)_2(Fe_{(1-j)}Co_j)_{17}N_3$ relative to the whole $(Sm_{(1-i)}R_i)_2(Fe_{(1-j)}Co_j)_{17}N_h$ is preferably 70 mass % or more, more preferably 80 mass % or more, still more preferably 90 mass %. On the other hand, $(Sm_{(1-i)}R_i)_2(Fe_{(1-j)}Co_j)_{17}N_h$ need not be entirely $(Sm_{(1-i)}R_i)_2(Fe_{(1-j)}Co_j)_{17}N_3$. The content of $(Sm_{(1-i)}R_i)_2(Fe_{(1-j)}Co_j)_{17}N_3$ relative to the whole $(Sm_{(1-i)}R_i)_2(Fe_{(1-j)}Co_j)_{17}N_h$ may be 98 mass % or less, 95 mass % or less, or 92 mass % or less.

The content of the magnetic phase 10 relative to the whole rare earth magnet 100 is preferably 70 mass % or more, preferably 75 mass % or more, preferably 80 mass % or more. The content of the magnetic phase 10 relative to the whole rare earth magnet 100 is not 100 mass %, because the rare earth magnet 100 contains a Zn phase 20 and an intermediate phase 30. On the other hand, in order to ensure appropriate amounts of Zn phase 20 and intermediate phase 30, the content of the magnetic phase 10 relative to the whole rare earth magnet 100 may be 99 mass % or less, 95 mass % or less, or 90 mass % or less.

The content of $Sm_2(Fe_{(1-i)}Co_i)_{17}N_h$ relative to the whole magnetic phase 10 is preferably 90 mass % or more, more preferably 95 mass % or more, still more preferably 98 mass % or more. The content of $Sm_2(Fe_{(1-i)}Co_i)_{17}N_h$ relative to the whole magnetic phase 10 is not 100 mass %, because the magnetic phase 10 contains O and $M^1$, in addition to $Sm_2(Fe_{(1-i)}Co_i)_{17}N_h$.

The particle diameter of the magnetic phase 10 is not particularly limited. The particle diameter of the magnetic phase 10 may be, for example, 1 μm or more, 5 μm or more, or 10 μm or more, and may be 50 μm or less, 30 μm or less, or 20 μm or less. In the present description, unless otherwise indicated, the particle diameter means an equivalent-circle diameter of projected area, and in the case where the particle diameter is indicated with a range, 80% or more of all particles are distributed in that range.

(Zn Phase)

As illustrated in FIG. 1B, a Zn phase 20 is present around a magnetic phase 10. As described later, an intermediate layer 30 is present between the magnetic phase 10 and the Zn phase 20, and therefore the Zn phase 20 is present in the outer periphery of the intermediate phase 30.

The Zn phase 20 is, as described above, derived by coating of the particles of the magnetic raw material powder with metallic Zn and/or a Zn alloy in the improving agent powder at the time of mixing of the magnetic raw material powder and the improving agent powder. Since the improving agent powder contains at least either one of metallic Zn and a Zn alloy, the Zn phase 20 as used in the present description means a phase containing at least either one of metallic Zn and a Zn alloy.

The thickness of the Zn phase 20 is not particularly limited. The thickness of the Zn phase may be, on average, for example, 1 nm or more, 10 nm or more, or 100 nm or more, and may be 1,000 nm or less, 500 nm or less, or 250 nm or less. In the case where the magnetic rare earth 100 is in the form illustrated in FIG. 2, an average of shortest distances between particles each having a magnetic phase 10 and an intermediate phase 30 is taken as the thickness of the Zn phase 20.

(Intermediate Phase)

As illustrated in FIG. 1B, the intermediate phase 30 is present between the magnetic phase 10 and the Zn phase 20. The particles 50 (see FIG. 1A) of the mixed powder are heat-treated, and oxygen in the oxidized phase 15 thereby combines with Zn in the Zn phase 20 and forms an intermediate phase 30. Accordingly, the intermediate phase 30 contains Zn. When the content of Zn in the intermediate phase 30 is 5 at % or more relative to the whole rare earth magnet 100, the enhancement of coercive force by the intermediate phase 30 can be clearly recognized. From the viewpoint of enhancing the coercive force, the content of Zn in the intermediate phase 30 is more preferably 10 at % or more, still more preferably 15 at % or more. On the other hand, when the content of Zn in the intermediate phase 30 is 60 at % or less relative to the whole rare earth magnet 100, reduction in the magnetization can be suppressed. From the viewpoint of suppressing reduction in the magnetization, the content of Zn in the intermediate phase 30 is more preferably 50 at % or less, still more preferably 30 at % or less, relative to the whole rare earth magnet 100. Incidentally, the content of Zn in the intermediate phase 30 is an average value of EDX analysis results in the intermediate phase 30.

The oxygen content of the intermediate phase 30 is higher than the oxygen content of the Zn phase 20, and oxygen is enriched in the intermediate layer 30. The coercive force of the rare earth magnet 100 can be enhanced by this enrichment. When the oxygen content of the intermediate phase 30 is 1.5 times or higher than the oxygen content of the Zn phase 20, the coercive force can be more enhanced. From the viewpoint of enhancing the coercive force, the oxygen content of the intermediate phase 30 is more preferably 3.0 times or higher, still more preferably 6.0 times or more higher, than the oxygen content of the Zn phase 20. On the other hand, when the oxygen content of the intermediate phase 30 is 20.0 times or less the oxygen content of the Zn phase 20, it can be avoided to add a larger amount of Zn in the case that the coercive force is not enhanced any more. From this viewpoint, the oxygen content of the intermediate phase 30 is more preferably 15.0 times or less, still more preferably 10.0 times or less, the oxygen content of the Zn phase 20. Incidentally, the oxygen contents in the Zn phase 20 and the intermediate phase 30 are an average value of EDX analysis results in the Zn phase 20 and the intermediate phase 30, respectively.

(Texture Parameter α)

As described above, the α-Fe phase 12 and the unmatched interface 14 disappear due to formation of the intermediate phase 30. Although not bound by theory, resulting from disappearance of the α-Fe phase 12 and the unmatched interface 14, a facet interface 17 is formed between the magnetic phase 10 and the intermediate phase 30. The facet interface 17 includes, for example, low index planes such as (101) plane, (100) plane, (101) plane, (201) plane, (−102) plane and (003) plane.

The crystallinity in the intermediate phase 30 is enhanced by the formation of such a facet interface 17. Thus, the anisotropic magnetic field in the intermediate phase 30 becomes equal to the anisotropic magnetic field of the magnetic phase 10. As a result, the coercive force of the rare earth magnet 100 is enhanced.

The crystallinity of the rare earth magnet 100 can be expressed using a texture parameter α. The calculation method of a is generally known, and the parameter can be calculated by the Kronmuller formula. The Kronmuller formula is represented by $H_c=\alpha\cdot H_a-N_{eff}\cdot M_s$ ($H_c$ is the coercive force, $H_a$ is the anisotropic magnetic field, $M_s$ is the saturation magnetization, and $N_{eff}$ is the self-demagnetizing field coefficient).

When α is 0.07 or more, the crystallinity of the intermediate phase 30 is increased, and enhancement of the coercive force is recognized. From the viewpoint of increasing the crystallinity, α is more preferably 0.11 or more, still more preferably 0.15 or more. On the other hand, when α is 1, a lattice defect is not present at all on the crystal surface of the rare earth magnet 100, but this is unrealistic, and when α is from 0.45 to 0.55, it can be said that the crystallinity is very high. Accordingly, α may be 0.55 or less, 0.50 or less, or 0.45 or less. Furthermore, even when α is 0.30 or less, 0.25 or less, 0.20 or less, or 0.15 or less, an increase of the crystallinity is substantially recognized, as a result, the effect of enhancing the coercive force is substantially recognized as well.

As described above, the oxygen content of the intermediate phase 30 is higher than the oxygen content of the Zn phase 20, and oxygen is enriched in the intermediate phase 30. This enrichment leads to the disappearance of α-Fe phase 12 and unmatched interface 14 illustrated in FIG. 1A. There is a strong correlation between this disappearance and the increase of crystallinity, and therefore a high a value indicates that the oxygen content of the intermediate phase 30 is higher than the oxygen content of the Zn phase 20 and oxygen is enriched in the intermediate phase 30. When α is 0.070 or more, it can be said that oxygen is enriched in the intermediate phase 30

Furthermore, when α is 0.090 or more, at the time of obtaining a sintered magnet (including a case of employing liquid phase sintering) from the mixed powder of the magnetic raw material powder and the improving agent powder, not only the coercive force of the sintered magnet surpasses the coercive force possessed by the magnetic raw material powder but also the coercive force of the sintered magnet at high temperature is excellent. When α is 0.090 or more, a coercive force of 550 A/m or more is obtained even at high temperature (160° C.), and ease of application, for example, to an in-vehicle motor is facilitated. From the viewpoint of ensuring the coercive force at high temperature, a may be 0.090 or more.

(Oxygen Content Relative to Whole Rare Earth Magnet)

Oxygen present in the rare earth magnet 100 is derived from the mixed powder of the magnetic raw material powder and the improving agent powder. In the rare earth magnet 100, a mixed powder where the oxygen content in the improving agent powder is 1.0 mass % or less relative to the whole improving agent powder, is used. Use of this mixed powder makes it possible to enrich oxygen in the intermediate phase 30 and enhance the coercive force even when a magnetic raw material powder having a large oxygen content is used. Therefore, even when a comparatively large amount of oxygen remains (is contained) in the rare earth magnet 100 after heat treatment, the coercive force can be sufficiently enhanced.

More specifically, even when the oxygen content is 1.55 mass % or more, 2.00 mass % or more, or 2.25 mass % or more, relative to the whole rare earth magnet 100, the coercive force can be sufficiently enhanced. On the other hand, when the oxygen content is 3.00 mass % or less, 2.75 mass % or less, or 2.50 mass % or less, relative to the whole rare earth magnet 100, enhancement of the coercive force can hardly be prevented.

Production Method

The production method of a rare earth magnet 100 of the present disclosure is described below. The production method of a rare earth magnet 100 of the present disclosure includes a step of preparing a mixed powder and a step of heat-treating the mixed powder. Each step is described below.

(Step of Preparing Mixed Powder)

First, a mixed powder is obtained by mixing a magnetic raw material powder containing Sm, Fe, and N with an improving agent powder containing at least either one of metallic Zn and a Zn alloy such that the content of Zn component in the improving agent powder is from 1 to 20 mass % relative to the total of the magnetic raw material powder and the improving agent powder.

The magnetic raw material powder contains Sm, Fe, and N. The magnetic raw material powder may contain the above-described magnetic phase 10 represented by $(Sm_{(1-i)}R_i)_2(Fe_{(1-j)}Co_j)_{17}N_h$. As for the magnetic phase 10 represented by $(Sm_{(1-i)}R_i)_2(Fe_{(1-j)}Co_j)_{17}N_h$, the same as the contents described in the rare earth magnet 100 can hold true.

The magnetic raw material powder may contain oxygen and $M^1$, in addition to the magnetic phase 10 represented by $(Sm_{(1-i)}R_i)_2(Fe_{(1-j)}Co_j)_{17}N_h$, within the range not compromising the magnetic properties of the rare earth magnet 100. From the view point of ensuring the magnetic properties of the rare earth magnet 100, the content of the magnetic phase 10 represented by $(Sm_{(1-i)}R_i)_2(Fe_{(1-j)}Co_j)_{17}N_h$ relative to the whole magnetic raw material powder may be 80 mass % or more, 85 mass % or more, or 90 mass % or more. On the other hand, even when the content of the magnetic phase 10 represented by $(Sm_{(1-i)}R_i)_2(Fe_{(1-j)}Co_j)_{17}N_h$ is not excessively increased, there is no problem in practical use. Accordingly, the content thereof may be 97 mass % or less, 95 mass % or less, or 93 mass % or less. The remainder of the magnetic phase 10 represented by $(Sm_{(1-i)}R_i)_2(Fe_{(1-j)}Co_j)_{17}N_h$ is the content of O and $M^1$.

In the production method of the present disclosure, a magnetic raw material powder having a comparatively large oxygen content can be used, and therefore the upper limit of the oxygen content of the magnetic raw material powder may be comparatively high relative to the whole raw material powder. For this reason, the oxygen content of the magnetic raw material powder may be 3.0 mass % or less, 2.5 mass % or less, or 2.0 mass % or less, relative to the whole magnetic raw material powder. On the other hand, the oxygen content in the magnetic raw material powder is preferably smaller, but decreasing the oxygen amount in the magnetic raw material powder to an extreme extent causes an increase in the production cost. For this reason, the oxygen amount of the magnetic raw material powder may be 0.1 mass % or more, 0.2 mass % or more, or 0.3 mass % or more, relative to the whole magnetic raw material powder.

The particle diameter of the magnetic raw material powder is not particularly limited. The particle diameter of the magnetic raw material powder may be, for example, 1 μm or more, 5 μm or more, or 10 μm or more, and may be 50 μm or less, 30 μm or less, or 20 μm or less.

The improving agent powder contains at least either one of metallic Zn and a Zn alloy. The improving agent powder contains, for example, at least either one of metallic Zn and a Zn alloy, which are represented by $Zn_{(1-s-t)}M^2_sO_t$. Incidentally, the matters regarding the improving agent powder represented by $Zn_{(1-s-t)}M^2_sO_t$ include the contents described in the rare earth magnet 100.

In the formula represented by $Zn_{(1-s-t)}M^2_sO_t$, O represents oxygen constituting an oxide or adsorbate with part of Zn or Zn alloy in the improving agent powder, and t is the sum total of such oxygen.

When the oxygen content of the improving agent powder is 1.0 mass % or less relative to the whole improving agent powder, the coercive force can be enhanced by enriching oxygen in the intermediate phase 30. From the viewpoint of enriching oxygen, the oxygen content of the improving agent powder is preferably smaller relative to the whole improving agent powder. The oxygen content of the improving agent powder may be 0.8 mass % or less, 0.6 mass % or less, 0.4 mass % or less, or 0.2 mass % or less, relative to the whole improving agent powder. On the other hand, if the oxygen content of the improving agent powder is excessively decreased relative to the whole improving agent powder, this causes an increase in the production cost. From this viewpoint, the oxygen content of the improving agent powder may be 0.01 mass % or more, 0.05 mass % or more, or 0.09 mass % or more, relative to the whole improving agent powder.

In order to enrich as much oxygen as possible in the intermediate phase 30, it is important to increase the contact area of the magnetic raw material powder with the improving agent powder, in addition to decreasing the oxygen content of the improving agent powder. The contact area of the magnetic raw material powder with the improving agent powder is affected by the particle diameters of the magnetic raw material powder and the improving agent powder. In view of magnetic properties, the degree of freedom in the particle diameter of the magnetic raw material powder is not so large, compared with the particle diameter of the improving agent powder. For this reason, practically, the oxygen enrichment in the intermediate phase 30 is often enhanced by controlling the particle diameter of the improving agent powder. With respect to the improving agent powder, the relationship between oxygen content and particle diameter is described in detail later.

The formula represented by $Zn_{(1-s-t)}M^2_sO_t$ encompasses both a case of indicating a Zn alloy represented by $Zn_{(1-s-t)}M^2_sO_t$, and a case where the average composition of the mixture of metallic Zn and a Zn alloy is represented by $Zn_{(1-s-t)}M^2_sO_t$. Incidentally, when s in the formula above is 0, the improving agent powder is a metallic Zn powder.

The Zn alloy includes, for example, a Zn—Sn alloy (eutectic temperature: 200° C.), a Zn—Mg alloy (eutectic temperature: 341° C.), and a Zn—Al alloy (eutectic temperature: 380° C.). The Sn content of the Zn—Sn alloy may be appropriately determined in the range of 2 to 98 at % and may be, for example, from 30 to 90 at %. The Mg content of the Zn—Mg may be appropriately determined in the range of 5 to 50 at % and may be, for example, from 5 to 15 at %. The Al content of the Zn—Al alloy may be appropriately determined in the range of 2 to 95 at % and may be, for example, from 5 to 25 at %.

The particle diameter of the improving agent powder may be appropriately determined in relation to the particle diameter of the magnetic raw material powder so that an intermediate phase 30 can be formed. The particle diameter of the improving agent powder may be, for example, 10 nm or more, 100 nm or more, 1 μm or more, 3 μm or more, or 10 μm or more, and may be 500 μm or less, 300 μm or less, 100 μm or less, 50 μm or less, or 20 μm or less. In the case where the particle diameter of the magnetic raw material powder is from 1 to 10 μm, in order to unfailingly coat the magnetic raw material powder with the improving agent powder, the particle diameter of the improving agent powder may be 200 μm or less, 100 μm or less, 50 μm or less, or 20 μm or less.

If the particle diameter of the improving agent powder is inadequate and the intermediate phase 30 is not formed, the above-described texture parameter α is rapidly decreased, and α becomes 0.030 or less.

As described above, the relationship between oxygen content and particle diameter in the improving agent powder is important for more enhancing the coercive force.

For example, when the particle diameter of the improving agent powder is in a certain range, the coercive force is enhanced with a decrease in the oxygen content of the improving agent powder and eventually, the enhancement of the coercive force is saturated. In this way, even when the oxygen content of the improving agent powder is low, if the particles of the improving agent powder are large, the enhancement of the coercive force is limited.

On the other hand, when the oxygen content of the improving agent powder is in a certain range, the coercive force is enhanced with a decrease in the particle diameter of the improving agent powder and eventually, the enhancement of the coercive force is saturated. In this way, even when the particle diameter of the improving agent powder is small, if the oxygen content of the improving agent powder is high, the enhancement of the coercive force is limited.

In addition, for example, in the case where the particle diameter of the improving agent powder is small, the oxygen content is readily saturated, but when a non-oxidized portion even slightly remains on the particle surface of the improving agent powder, the improving agent can absorb a sufficient amount of oxygen. Although not bound by theory, it is because the non-oxidized portion is likely to turn into a liquid phase during heat treatment and/or sintering (including liquid-phase sintering) and the improving agent powder is semi-melted or melted in the non-oxidized portion to facilitate coating of the magnetic raw material powder with the improving agent.

As understood from the exemplary contents described in the foregoing pages, it is preferable for more enhancing the coercive force to determine the relationship between the oxygen content of the improving agent powder and the particle diameter of the improving agent powder. As for the particle diameter of the improving agent powder, it is more preferable to further take into consideration the form of the improving agent powder. The form of the improving agent powder may be represented by the relationship between volume and surface area of each individual particle of the improving agent powder.

With respect to a unit particle of the improving agent powder, denoting C (mass %) as the oxygen content and denoting S ($cm^{-1}$) as the ratio of the surface area to the volume, the value of S/C ($cm^{-1}$·mass $\%^{-1}$) is preferably 90,000 or more. When the value of S/C is 90,000 or more, even in the case of sintering (including liquid-phase sintering) the magnetic raw material powder and the improving agent powder, the coercive force of the sintered powder can surpass the coercive force possessed by the magnetic raw material powder and at the same time, the texture parameter α can be 0.07 or more. From these viewpoints, the value of S/C is more preferably 95,000 or more, still more preferably 100,000 or more. On the other hand, theoretically, the value of S/C is preferably higher but practically, may be 350,000 or less, 300,000 or less, or 250,000 or less.

Although not bound by theory, S/C has the following technical meaning. For making S/C large, it is better to decrease the oxygen content C of the improving agent powder and increase S. In order to increase S, with respect to a unit particle of the improving agent powder, it is better to increase the surface area and decrease the volume. Increasing S typically includes decreasing the particle diameter of the improving agent powder.

The improving agent powder is an aggregate of a large number of improving agent particles. The shape (form) and size are not the same among the individual improving agent particles. The unit particle of the improving agent powder means a particle having physical property values representative of the whole improving agent powder used.

The oxygen content C (mass %) of the unit particle of the improving agent particles (hereinafter, sometimes simply referred to as "unit particle") is represented by the oxygen content (mass %) of the whole improving agent powder used. The particle diameter d (cm) of the unit particle is represented by the average particle diameter of the whole improving agent powder used. In the present description, unless otherwise indicated, the particle diameter means an equivalent-circle diameter of projected area, and the average particle diameter is an average thereof. The volume ($cm^3$) of the unit particle is represented by $4/3\pi(d/2)^3$. The surface area ($cm^2$) of the unit particle is represented by $4\pi(d/2)^2$. The ratio S ($cm^{-1}$) of the surface area to the volume is represented by $(4\pi(d/2)^2)/(4/3\pi(d/2)^3)$.

A small amount of petroleum may be added to the improving agent powder. The addition of petroleum makes it possible to suppress oxidation, improve lubricity with the magnetic raw material powder and uniformly mix the powders. The petroleum usable for mixing include heptane, octane, or hexane, and a combination thereof, etc.

The magnetic raw material powder and the improving agent powder are weighed such that the content of a Zn component in the improving agent powder is from 1 to 20 mass % relative to the total of the magnetic raw material powder and the improving agent powder, and mixed. The atmosphere at the time of weighing and mixing is preferably an inert gas atmosphere so As for prevent oxidation of the magnetic raw material powder and the improving agent powder. The inert gas atmosphere includes a nitrogen gas atmosphere.

When the content of the Zn component is 1 mass % or more, the intermediate phase 30 can be formed. From the viewpoint of forming the intermediate phase 30, the content of the Zn component is preferably 3 mass % or more, more preferably 6 mass % or more, still more preferably 9 mass % or more. On the other hand, when the content of the Zn component is 20 mass % or less, reduction in the magnetization can be suppressed. From the viewpoint of suppressing reduction in the magnetization, the content of the Zn component is preferably 18 mass % or less, more preferably 15 mass % or less, still more preferably 12 mass % or less. Incidentally, in the present description, the Zn component means the content of only Zn, excluding $M^2$ and O, in the case where the improving agent powder contains an alloy represented by $Zn_{(1-s-t)}M^2_sO_t$.

The magnetic raw material powder contains a magnetic phase 10. The magnetic phase 10 is an intermetallic compound, and therefore the particles of the magnetic raw material powder are hard. The improving agent powder contains metallic Zn and/or a Zn alloy. The metallic Zn and Zn alloy are a metal material, and therefore the particles of the improving agent particle are soft. Accordingly, when the magnetic raw material powder and the improving agent powder are mixed, the particles of the improving agent powder are deformed, and the outer peripheries of the particles of the magnetic raw material powder are coated with metallic Zn an/or a Zn alloy in the improving agent powder. However, if the particle diameter of the improving agent powder is excessively large relative to the particle diameter of the magnetic raw material powder, the coating above can hardly be realized. As a result, it is difficult to obtain the intermediate phase 30.

In addition, since the improving agent powder is lower in the melting point than the magnetic raw material powder, in the case of simultaneously performing mixing and heat treatment of the magnetic raw material powder and the improving agent powder, the improving agent powder is first melted, and the outer peripheries of the particles of the magnetic raw material powder are coated with metallic Zn or a Zn alloy in the improving agent powder. The heat treatment is described later.

The mixing machine used for the mixing of the magnetic raw material powder and the improving agent powder is not particularly limited. The mixing machine includes a muller wheel mixer, an agitator mixer, a mechanofusion, a V-type mixer, a ball mill, etc. From the viewpoint of coating the outer peripheries of the particles of the magnetic raw material powder with metallic Zn or a Zn alloy in the improving agent powder, a ball mill is preferably used. In the case of simultaneously performing mixing and heat treatment, a rotary kiln, etc. may be used. The V-type mixer is an apparatus having a container formed by connecting two cylindrical containers in V shape, in which the powders in the container are mixed through repeated aggregation and separation due to gravity and centrifugal force by rotating the container.

At the time of mixing of the magnetic raw material powder with the improving agent powder, a hard ball may be used. By using a hard ball, the adhesiveness of the coat to the particles of the magnetic raw material powder can be enhanced. Consequently, not only the coat is less likely to fall off but also oxygen in the oxidized phase 15 readily reacts with the Zn phase 20, making it possible to form a uniform intermediate phase 30. As a result, the coercive force is enhanced.

In addition, by using a hard ball, the magnetic raw material powder and the improving agent powder can be more uniformly mixed. Depending on the mixing conditions, the powders may be mixed while pulverizing the particles of the magnetic raw material powder and the improving agent powder.

Pulverization of the particles of the magnetic raw material powder reduces the particle diameter of the magnetic phase 10 and in turn, the magnetization and coercive force of the rare earth magnet 100 can be enhanced. Reduction in the particle diameter of the magnetic phase 10 enables fine and magnetic separation of the particles exhibiting magnetization and therefore, the pulverization of the particles of the magnetic raw material powder contributes particularly to the enhancement of the coercive force.

Pulverization of the particles of the improving agent powder reduces the particle diameter of the particles of the improving agent powder and facilitates coating of the outer peripheries of the particles of the magnetic raw material powder with metallic Zn and/or a Zn alloy.

The material and particle diameter of the hard ball are not particularly limited. The material of the hard ball includes steel, stainless steel, ceramic, and nylon, etc. The particle diameter of the hard ball may be, for example, 0.5 mm or more, 1.0 mm or more, 2.5 mm or more, or 4.0 mm, and may be 20.0 mm or less, 10.0 mm or less, 8.0 mm or less, or 6.0 mm or less.

The mixing time and the rotating speed of the mixing machine may be appropriately determined by taking into consideration, for example, the kind of mixing machine, the rotating speed of mixing machine, and the amount of powder. The mixing time may be, for example, 10 minutes or more, 30 minutes or more, or 50 minutes or more, and may be 120 minutes or less, 90 minutes or less, or 70 minutes or less. The rotating speed of the mixing machine may be, for example, 70 rpm or more, 90 rpm or more, or 110 rpm or more, and may be 300 rpm or less, 250 rpm or less, or 200 rpm or less.

(Step of Heat-Treating Mixed Powder)

Denoting T° C. as the lowest melting point out of the melting points of the metallic Zn or Zn alloy contained in the mixed powder 50, the mixed powder 50 (see FIG. 1A) prepared is heat-treated at T−30° C. or more and 500° C. or less. This heat treatment causes oxygen in the magnetic phase 10 to diffuse into the Zn phase 20 of the mixed powder 50 and enriches oxygen in the intermediate phase 30 (see FIG. 1B). Furthermore, Ia-3-type $Sm_2O_3$ is formed in the intermediate phase 30. Although not bound by theory, compared with the case where hcp-type $Sm_2O_3$ is formed, when Ia-3-type $Sm_2O_3$ is formed, a facet interface 17 is likely to be formed between the magnetic phase 10 and the intermediate phase 30, and crystallinity of the intermediate phase is enhanced, contributing to the increase in the coercive force.

Denoting T° C. as the lowest melting point out of the melting points of the metallic Zn or Zn alloy contained in the mixed powder 50, when the heat treatment temperature is T−30° C. or more, the mixed powder 50 is softened or liquefied, as a result, oxygen in the magnetic phase 10 diffuses into the Zn phase 20 of the mixed powder 50, and oxygen is enriched in the intermediate phase 30. From the viewpoint of enriching oxygen, the heat treatment temperature may be (T−20) ° C. or more, (T−10)° C. or more, or T° C. or more.

The melting point of the Zn alloy is defined as the melting initiation temperature. In the case where the Zn alloy is a eutectic alloy, the melting initiation temperature is defined as a eutectic temperature.

The phrase "Denoting T° C. as the lowest melting point out of the melting points of the metallic Zn or Zn alloy contained in the mixed powder 50, the mixed powder is heat-treated at T−30° C. or more and 500° C. or less" means the following. Incidentally, the heat treatment temperature indicates the holding temperature.

In the case where the mixed powder 50 contains metallic Zn and does not contain a Zn alloy, T is the melting point of the metallic Zn. Since the melting point of metallic Zn is 419.5° C., the heat treatment temperature is 389.5 (419.5−30)° C. or more and 500° C. or less.

In the case where the mixed powder 50 does not contain metallic Zn and contains a Zn alloy, T is the melting point of the Zn alloy. In the case where the Zn alloy is a plurality of kinds of Zn alloys, T is the lowest melting point out of melting points of those Zn alloys. For example, in the case of containing a Zn—Sn alloy (eutectic temperature: 200° C.) and a Zn—Mg alloy (eutectic temperature: 341° C.) as the Zn alloy, the heat treatment temperature is 170 (200−30) ° C. or more and 500° C. or less.

In the case where the mixed powder 50 contains both metallic Zn and a Zn alloy, T is the melting point of the Zn alloy. For example, in the case where the improving agent powder contains metallic Zn and a Zn—Mg alloy (eutectic temperature: 341° C.), the heat treatment temperature is 311 (341−30)° C. or more and 500° C. or less.

When the heat treatment temperature is 500° C. or less, the coercive force is not reduced. Although not bound by theory, it is believed that if the heat treatment temperature exceeds 500° C., nitrogen of the magnetic phase 10 dissociates to cause decomposition of the magnetic phase 10 and as a result, the coercive force is reduced. From the viewpoint of suppressing reduction in the coercive force, the heat treatment temperature may be 490° C. or less, 470° C. or less, or 450° C. or less.

The heat treatment time may be appropriately determined according to the amount of mixed powder, etc. The heat treatment time excludes the temperature rise time until reaching the heat treatment temperature. The heat treatment time may be, for example, 10 minutes or more, 30 minutes or more, or 50 minutes or more, and may be 600 minutes or less, 240 minutes or less, or 120 minutes or less.

After the elapse of the heat treatment time, the heat treatment is terminated by rapidly cooling the heat-treatment object. Oxidation, etc. of the rare earth magnet 100 can be prevented by rapid cooling. The rapid cooling rate may be, for example, from 2 to 200° C./sec.

The heat treatment atmosphere is preferably an inert gas atmosphere so As for prevent oxidation of the magnetic raw material powder and the improving agent powder. The inert gas atmosphere includes a nitrogen gas atmosphere.

(Simultaneous Treatment of Mixing and Heat Treatment)

Figure 3A:
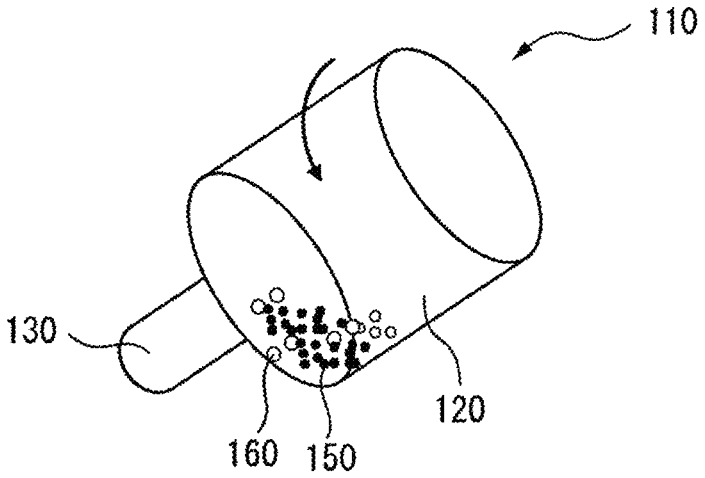
FIG. 3A is a diagram illustrating the state before the improving agent powder is melted.
Figure 3B:
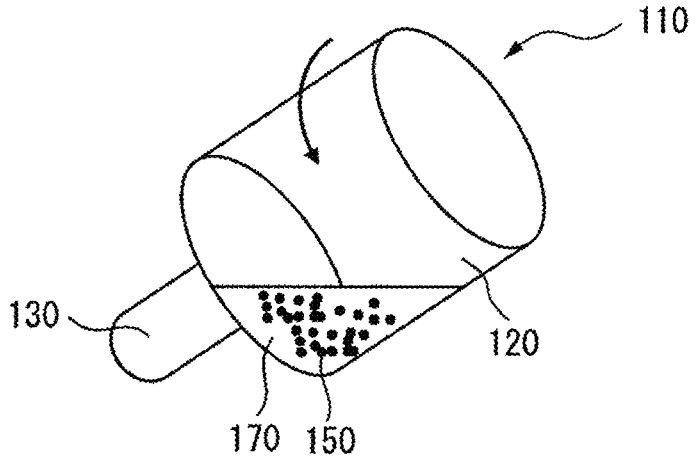
FIG. 3B is a diagram illustrating the state after the improving agent powder is melted.

Mixing and heat treatment of the magnetic raw material powder and the improving agent powder may be performed at the same time. FIGS. 3A and 3B are diagrams schematically illustrating one example of the case where mixing and heat treatment of the magnetic raw material powder and the improving agent powder are performed at the same time. FIG. 3A is a diagram illustrating the state before the improving agent powder is melted, and FIG. 3B is a diagram illustrating the state after the improving agent powder is melted.

FIG. 3 shows the case using a rotary kiln, but the apparatus is not limited thereto as long as mixing and heat treatment can be performed simultaneously. The rotary kiln (not shown) has an agitating drum 110. The agitating drum 110 has a material storing part 120 and a rotary shaft 130. The rotary shaft 130 is connected with a rotary means (not shown) such as electric motor.

A magnetic raw material powder 150 and an improving agent powder 160 are charged into the material storing part 120. Thereafter, the material storing part 120 is heated to obtain a melt 170 of the improving agent powder 160, and the magnetic raw material powder 150 is put into contact with the melt 170.

As for the rotating speed of the material storing part 120, if the rotating speed is too fast, the magnetic raw material powder 150 in the melt 170 is pressed against the inner wall of the material storing part 120, and the stirring effect is thereby reduced. On the other hand, if the rotating speed of the material storing part 120 is too slow, the magnetic raw material powder 150 settles in the melt 170, and the stirring effect is reduced.

A uniform intermediate phase 30 can be formed by appropriately setting the rotating speed of the material storing part 120. In order to obtain a uniform intermediate phase 30, the rotating speed of the material storing part 120 may be, for example, 5 rpm or more, 10 rpm or more, or 20 rpm or more, and may be 200 rpm or less, 100 rpm or less, or 50 rpm or less.

The heating temperature, heating time and heating atmosphere may be determined with reference to the above-described heat treatment temperature, heat treatment time and heat treatment atmosphere, respectively.

(Deposition Mixing)

Figure 15:
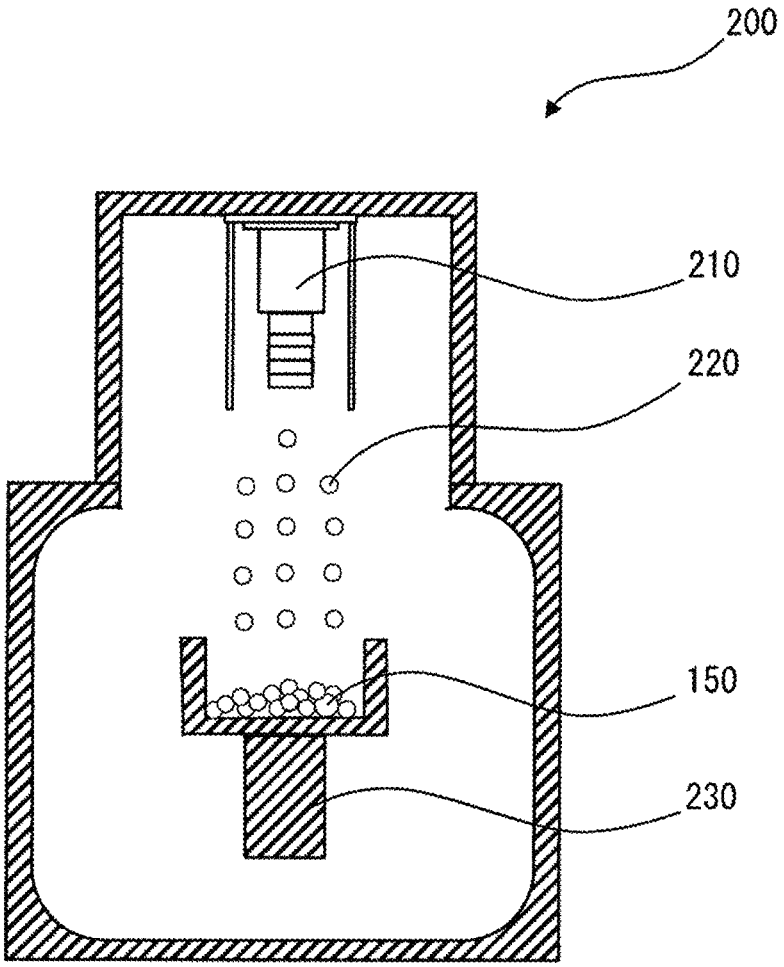
FIG. 15 is a diagram schematically illustrating one example of the case of mixing the magnetic raw material powder and the improving agent powder by using an arc plasma deposition apparatus.

The magnetic raw material powder and the improving agent powder may be mixed by depositing at least either one of metallic Zn and a Zn alloy in the improving agent powder on the surface of the magnetic raw material powder. For the deposition mixing, an arc plasma deposition apparatus, etc. can be used. FIG. 15 is a diagram schematically illustrating one example of the case of depositing metallic Zn and/or a Zn alloy on the surface of the particles of the magnetic raw material powder by using an arc plasma deposition apparatus.

The arc plasma deposition apparatus 200 has an arc plasma gun 210 and a stage 230. The arc plasma gun 210 and the stage 230 are facing each other. A magnetic raw material powder 150 is placed on the stage 230. An improving agent powder (not shown) is loaded into the arc plasm gun 210. Particles 220 of metallic Zn and/or a Zn alloy in the improving agent powder are emitted from the arc plasma gun 210 toward the stage 230. The particles 220 are vapors and/or liquid droplets. The particles 220 collide with particles of the magnetic raw material powder 150, and metallic Zn and/or a Zn alloy can thereby be deposited on the surface of the particles of the magnetic raw material powder 150 to provide a mixed powder.

(Compacting)

The mixed powder may be compacted before heat treatment. Individual particles of the mixed powder are caused to closely adhere to each other by compacting, so that a good intermediate phase 30 can be formed and the coercive force can be enhanced. The compacting method may be a conventional method such as pressing by using a mold. The pressing pressure may be, for example, 50 MPa or more, 100 MPa or more, or 150 MPa or more, and may be 1500 MPa or less, 1000 MPa or less, or 500 MPa or less.

The compacting may also be performed in a magnetic field. By this compacting, orientation can be imparted to the compact, and the magnetization can be enhanced. The method for compacting in a magnetic field may be a method generally performed at the time of production of a magnet. The magnetic field applied may be, for example, 0.3 T or more, 0.5 T or more, or 0.8 T or more, and may be 5.0 T or less, 3.0 T or less, or 2.0 T or less.

(Sintering)

One embodiment of heat treatment includes, for example, sintering. Typically, a compact of the mixed powder is sintered, but the sintering is not limited thereto. Sintering includes liquid-phase sintering where part of the material turns into a liquid phase. In the production method of a rare earth magnet of the present disclosure, typically, part of the improving agent powder is melted. As for the sintering method, a well-known method employed for the production of a rare earth magnet can be applied.

Figure 16:
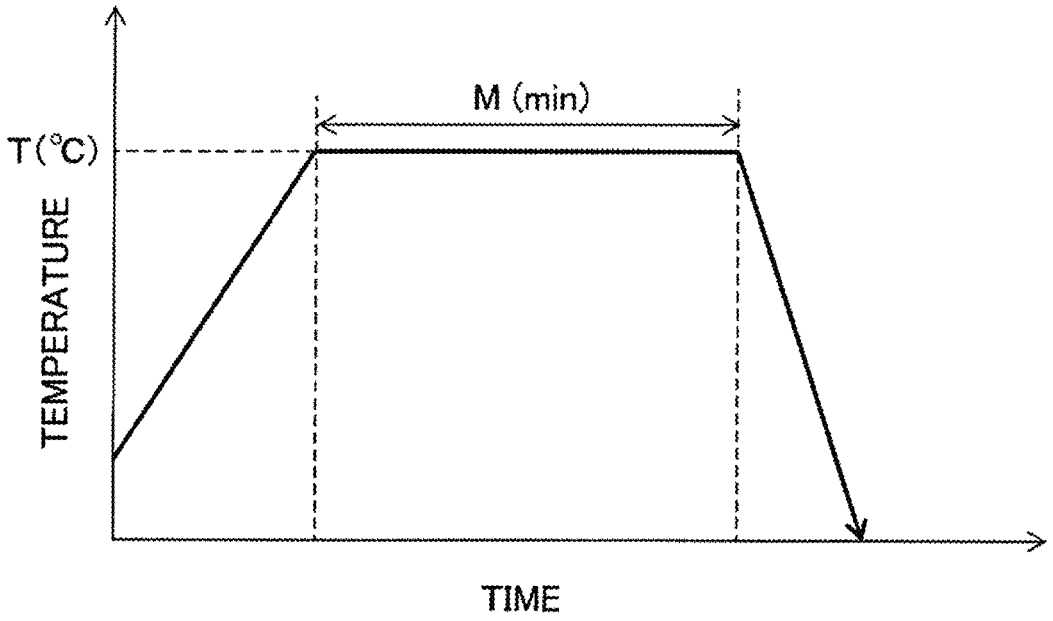
FIG. 16 is a diagram illustrating the heat cycle at the time of sintering.

Sintering conditions are described by referring to the drawing. FIG. 16 is a diagram illustrating the heat cycle at the time of sintering. In FIG. 16, T (° C.) indicates the sintering temperature. The sintering temperature may be determined with reference to the above-described heat treatment temperature. In FIG. 16, M (min) indicates the sintering time. In the sintering, as described later, the pressure is applied during heating, and therefore the sintering time may be short compared with the above-described heat treatment time. The sintering time may be, for example, 1 minute or more, 3 minutes or more, or 5 minutes or more, and may be 120 minutes or less, 60 minutes or less, or 40 minutes or less.

After the elapse of the sintering time, the sintering is terminated by removing the sintering object from the mold. The sintering atmosphere is preferably an inert gas atmosphere so As for prevent oxidation of the magnetic raw material powder and the improving agent powder. The inert gas atmosphere includes a nitrogen gas atmosphere.

The sintering method may be a conventional method and includes, for example, Spark Plasma Sintering (SPS), hot press by high-frequency heating, and hot press by focused light heating. The spark plasma sintering, hot press by high-frequency heating, and hot press by focused light heating are advantageous in that the temperature of the compact can be rapidly raised to the desired temperature and the crystal grain can be prevented from coarsening before the compact reaches the desired temperature.

As for the sintering, pressure sintering of applying pressure to the mold into which the compact is charged may be performed. The pressure sintering enhances sinterability. Since the compact contains an improving agent powder, when the sintering pressure is 0.80 GPa or more, the compact can be sintered even if the sintering temperature is in a low temperature region as in the range above. As a result, the density of the sintered body can be enhanced. Enhancement of the density of the sintered body leads to enhancement of the magnetic properties of a rare earth magnet obtained by the production method of the present disclosure. In view of sinterability, the sintering pressure is preferably 0.20 GPa or more, more preferably 0.50 GPa or more, still more preferably 0.95 GPa or more.

On the other hand, when the sintering pressure is 1.80 GPa or less, the sintered body is less likely to be cracked, as a result, "chipping" can hardly be generated in the sintered body. From the viewpoint of suppressing chipping of the sintered body, the sintering pressure is preferably 1.60 GPa or less, more preferably 1.50 GPa or less, still more preferably 1.40 GPa or less.

Durability is required of the mold used for pressure sintering. In view of durability of the mold, the sintering pressure is preferably lower. In the case where the mold is made of cemented carbide, the sintering pressure may be 1.80 GPa or less, 1.75 GPa or less, or 1.50 GPa or less. Incidentally, the cemented carbide is an alloy obtained by sintering tungsten carbide and cobalt as a binder.

In the case where the mold is made of a steel material, the sintering pressure is preferably further lower and may be, for example, 1.45 GPa or less, 1.30 GPa or less, or 1.15 GPa or less.

The steel material used for the mold includes, for example, carbon steel, alloy steel, tool steel and high-speed steel. The carbon steel includes, for example, SS540, S45C, and S15CK of the Japanese Industrial Standards. The alloy steel includes, for example, SCr445, SCM445, and SNCM447 of the Japanese Industrial Standards. The tool steel includes, for example, SKD5, SKD61, or SKT4 of the Japanese Industrial Standards. The high-speed steel includes, for example, SKH40, SKH55, and SKH59 of the Japanese Industrial Standards.

In the case where the sintering time M can be prolonged or where very high sinterability is not required, the sintering may be pressureless sintering. The sintering time in the case of pressureless sintering may be 5 minutes or more, 15 minutes or more, or 30 minutes or more, and may be 120 minutes or less, 90 minutes or less, or 60 minutes or less.

The sintering atmosphere is preferably an inert gas atmosphere so As for prevent oxidation of the compact and the sintered body during sintering. The inert gas atmosphere includes a nitrogen gas atmosphere.

EXAMPLES

The rare earth magnet of the present disclosure and the production method thereof are described more specifically below by referring to Examples and Comparative Examples. Incidentally, the rare earth magnet of the present disclosure and the production method thereof are not limited to the conditions employed in the following Examples.

Preparation of Sample

Samples of the rare earth magnet were prepared in the following manner.

Examples 1 to 5 and Comparative Examples 1 to 3

A magnetic raw material powder and an improving agent powder were mixed using a ball mill. As for the magnetic raw material powder, a powder having a $Sm_2Fe_{17}N_3$ content of 95 mass % or more relative to the whole magnetic raw material powder was used. As for the improving agent powder, a metallic Zn powder was used. The particle diameter of the magnetic raw material powder was 3 μm. The particle diameter of the improving agent powder was 1 μm. The total amount of the magnetic raw material powder and the improving agent powder was set to be 15 g. The rotating speed of the ball mill was set at 125 rpm. The rotation time was set at 60 minutes. At the time of mixing, 80 $cm^3$ of heptane was added to the magnetic raw material powder and the improving agent powder. At the time of mixing, 100 g of stainless steel balls of 1 mm in diameter and 50 g of stainless steel balls of 5 mm in diameter were added. The oxygen content of the magnetic raw material powder relative to the whole magnetic raw material powder, the oxygen content of the improving agent powder relative to the whole improving agent powder, and the amount of Zn component in the improving agent powder relative to the whole mixed powder are shown in Table 1. Incidentally, the oxygen content of each powder was measured by a non-dispersive infrared absorption method. Furthermore, with respect to Examples 1 to 5 and Comparative Examples 1 to 3, since a metallic Zn powder was used as the improving agent powder, the amount of Zn component in the improving agent powder relative to the whole mixed powder is the amount of the metallic Zn powder relative to the whole mixed powder.

In a magnetic field, 1.5 g of the mixed powder of the magnetic raw material powder and the improving agent powder was compacted to a size of 6.5 mm×7 mm. The magnetic field applied was set at 2.3 $MA \cdot M^{-1}$, and the molding pressure was set at 200 MPa.

The molded body was heat-treated over 30 minutes. The heat treatment was terminated by rapidly cooling the molded body at 200° C./sec. The heat treatment temperature is shown in Table 1.

Examples 6 to 8 and Comparative Examples 4 and 5

Mixing and heat treatment of a magnetic raw material powder and an improving agent powder were performed simultaneously by using a rotary kiln. As for the magnetic raw material powder, a powder having a $Sm_2Fe_{17}N_3$ content of 95 mass % or more relative to the whole magnetic raw material powder was used. As for the improving agent powder, a metallic Zn powder was used. The particle diameter of the magnetic raw material powder was 3 μm. The particle diameter of the improving agent powder was 7 μm. The total amount of the magnetic raw material powder and the improving agent powder was 10 g.

The oxygen content of the magnetic raw material powder relative to the whole magnetic raw material powder, the oxygen content of the improving agent powder relative to the whole improving agent powder, the amount of Zn in the improving agent powder relative to the whole mixed powder, and the heat treatment temperature are shown in Table 2. Incidentally, the oxygen content of each powder was measured by a non-dispersive infrared absorption method. Furthermore, with respect to Examples 6 to 8 and Comparative Examples 4 and 5, since a metallic Zn powder was used as the improving agent powder, the amount of Zn component in the improving agent powder relative to the whole mixed powder is the amount of the metallic Zn powder relative to the whole mixed powder.

Examples 9 to 14

A magnetic raw material powder and an improving agent powder were mixed using a V-type mixer. As for the magnetic raw material powder, a powder having a $Sm_2Fe_{17}N_3$ content of 95 mass % or more relative to the whole magnetic raw material powder was used. As for the improving agent powder, a metallic Zn powder was used. The particle diameter of the magnetic raw material powder was 3 μm. The particle diameter of the improving agent powder was from 20 to 65 μm. The total amount of the magnetic raw material powder and the improving agent powder was set to be 15 g. The oxygen content of the magnetic raw material powder relative to the whole magnetic raw material powder, the oxygen content of the improving agent powder relative to the whole improving agent powder, and the amount of Zn component in the improving agent powder relative to the whole mixed powder are shown in Table 4. Incidentally, the oxygen content of each powder was measured by a non-dispersive infrared absorption method. Furthermore, with respect to Examples 9 to 14, since a metallic Zn powder was used as the improving agent powder, the amount of Zn component in the improving agent powder relative to the whole mixed powder is the amount of the metallic Zn powder relative to the whole mixed powder.

In a magnetic field, 1.0 g of the mixed powder of the magnetic raw material powder and the improving agent powder was compacted to a size of 10 mm in diameter and 2 mm in height. The magnetic field applied was set at 1.0 T, and the molding pressure was set at 100 MPa. The molded body was pressure-sintered at 300 MPa over 5 to 30 minutes. The sintering temperature is shown in Table 4.

Examples 15 to 18 and Comparative Examples 6 to 8

A magnetic raw material powder and an improving agent powder were mixed using a ball mill. As for the magnetic raw material powder, a powder having a $Sm_2Fe_{17}N_3$ content of 95 mass % or more relative to the whole magnetic raw material powder was used. As for the improving agent powder, a metallic Zn powder was used. The particle diameter of the magnetic raw material powder was 3 μm. The particle diameter of the improving agent powder was from 3.3 to 1,000 μm. The total amount of the magnetic raw material powder and the improving agent powder was set to be 15 g. The oxygen content of the magnetic raw material powder relative to the whole magnetic raw material powder, the oxygen content of the improving agent powder relative to the whole improving agent powder, the amount of Zn component in the improving agent powder relative to the whole mixed powder, the particle diameter of the improving agent powder, and S/C are shown in Table 5. Incidentally, the oxygen content of each powder was measured by a non-dispersive infrared absorption method. Furthermore, with respect to Examples 15 to 18 and Comparative Examples 6 to 8, since a metallic Zn powder was used as the improving agent powder, the amount of Zn component in the improving agent powder relative to the whole mixed powder is the amount of the metallic Zn powder relative to the whole mixed powder.

In a magnetic field, 1.0 g of the mixed powder of the magnetic raw material powder and the improving agent powder was compacted to a size of 10 mm in diameter and 2 mm in height. The magnetic field applied was set at 1.0 T, and the molding pressure was set at 100 MPa. The molded body was sintered at 1 GPa over 5 minutes. The sintering temperature is shown in Table 5.

Evaluation

Each sample was measured for the coercive force and the magnetization. The measurement was performed using a pulsed BH tracer manufactured by Toei Industry Co., Ltd. The measurement was performed at normal temperature (room temperature), but with respect to Examples 9 to 14, the coercive force at 160° C. was also measured.

With respect to the sample of Example 5, line analysis was performed on the composition near the intermediate phase 30 by using STEM-EDX and EPMA. In addition, with respect to the sample of Example 5, the texture near the intermediate phase was observed by means of a high-angle annular dark-field scanning transmission electron microscope.

With respect to the samples of Example 5 and Comparative Example 3, X-ray diffraction (XRD) analysis was performed. With respect to the sample of Example 5, the texture near the intermediate phase 30 was observed by using a transmission electron microscope, and part thereof was subjected to electron beam diffraction analysis.

With respect to the sample of Comparative Example 8, the texture near the interface between the magnetic phase 10 and the Zn phase 20 was observed by using a scanning electron microscope.

Evaluation results of Examples 1 to 5 and Comparative Examples 1 to 3 are shown in Table 1. In Table 1, the oxygen amount of the magnetic raw material powder used for the preparation of each of the samples of Examples 1 to 5 and Comparative Examples 1 to 3 and the coercive force are shown together. Evaluation results of Examples 6 to 8 and Comparative Examples 4 and 5 are shown in Table 2. In Table 2, the oxygen amount of the magnetic raw material powder used for the preparation of each of the samples of Examples 6 to 8 and Comparative Examples 4 and 5 and the coercive force are shown together. Incidentally, the coercive force and the magnetization shown in Tables 1 and 2 are the measurements results at normal temperature (room temperature).

TABLE 1

| | Oxygen Content of Magnetic Raw Material Powder (mass %) | Oxygen Content of Improving Agent Powder (mass %) | Amount of Zn Component in Improving Agent Powder (mass %) | Heat Treatment Temperature (° C.) | Coercive Force (kA/m) | Residual Magnetization (T) | α | Oxygen Content of Rare Earth Magnet (after heat treatment) (mass %) |
|---|---|---|---|---|---|---|---|---|
| Example 1 | 0.75 | 0.087 | 5 | 475 | 1055 | 0.55 | 0.081 | 0.72 |
| Example 2 | 0.75 | 0.087 | 10 | 475 | 1623 | 0.56 | 0.118 | 0.69 |
| Example 3 | 0.75 | 0.087 | 5 | 500 | 914 | 0.51 | 0.072 | 0.72 |
| Example 4 | 0.75 | 0.087 | 10 | 500 | 1990 | 0.56 | 0.143 | 0.69 |
| Example 5 | 0.75 | 0.087 | 15 | 500 | 2649 | 0.48 | 0.184 | 0.66 |
| Comparative Example 1 | 0.75 | 9.9 | 5 | 475 | 361 | 0.56 | 0.035 | 1.19 |
| Comparative Example 2 | 0.75 | 1.5 | 5 | 475 | 788 | 0.60 | 0.063 | 0.79 |
| Comparative Example 3 | 0.75 | 1.5 | 10 | 475 | 820 | 0.61 | 0.065 | 0.82 |
| Magnetic Raw Material Powder | 0.75 | — | — | — | 857 | 1.3 | 0.052 | 0.75 |

TABLE 2

| | Oxygen Content of Magnetic Raw Material Powder (mass %) | Oxygen Content of Improving Agent Powder (mass %) | Amount of Zn Component in Improving Agent Powder (mass %) | Heat Treatment Temperature (° C.) | Coercive Force (kA/m) | Residual Magnetization (T) | α | Oxygen Content of Rare Earth Magnet (after heat treatment) (mass %) |
|---|---|---|---|---|---|---|---|---|
| Example 6 | 1.7 | 0.795 | 15 | 400 | 868 | 0.92 | 0.070 | 1.58 |
| Example 7 | 1.7 | 0.795 | 15 | 440 | 1002 | 0.90 | 0.077 | 1.58 |
| Example 8 | 1.7 | 0.795 | 15 | 460 | 1077 | 0.81 | 0.082 | 1.58 |
| Comparative Example 4 | 1.7 | 0.795 | 15 | 520 | 164 | 0.61 | 0.022 | 1.58 |
| Comparative Example 5 | 1.7 | 9.9 | 15 | 440 | 263 | 0.90 | 0.028 | 2.77 |
| Magnetic Raw Material Powder | 1.7 | — | — | — | 821 | 1.3 | 0.065 | — |

As seen from Table 1, it could be confirmed that when the oxygen content of the improving agent powder relative to the whole improving agent powder is 1.0 mass % or less, the coercive force is enhanced. In addition, as seen from Table 2, it could be confirmed that the same results are obtained also when mixing and heat treatment are performed using a rotary kiln. Furthermore, it could be confirmed that when the heat treatment temperature is 500° C. or less, the coercive force is not reduced.

Figure 4:
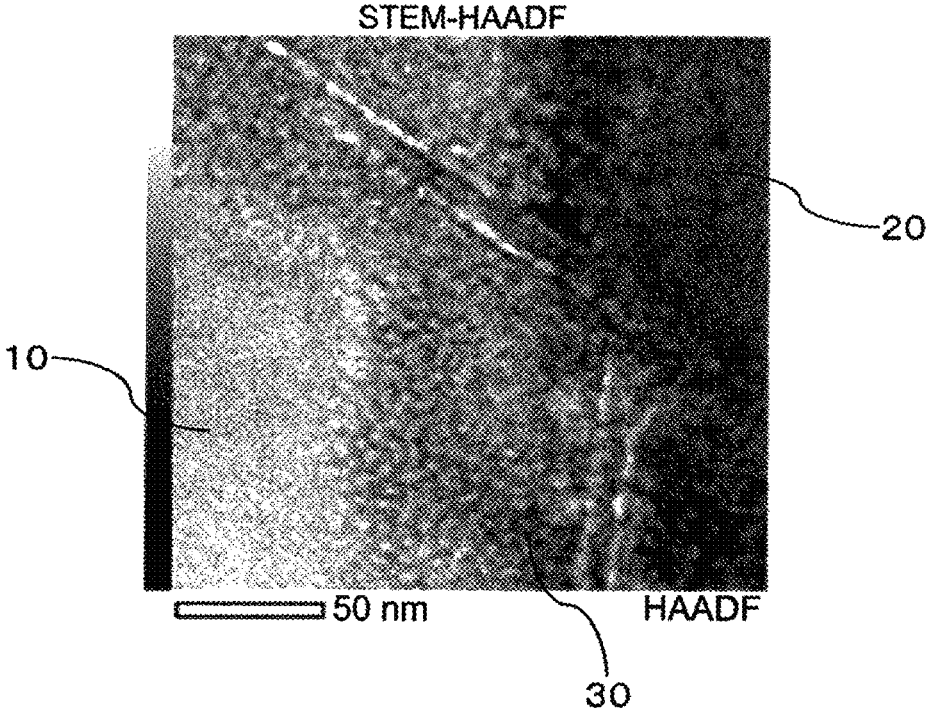
FIG. 4 is a diagram illustrating the results of, with respect to the sample of Example 5, observing the texture near the intermediate phase by using a scanning transmission electron microscope.

FIG. 4 is a diagram illustrating the results of, with respect to the sample of Example 5, observing the texture near the intermediate phase 30 by using a scanning transmission electron microscope. As seen from FIG. 4, it could be confirmed that in the sample of Example 5, an intermediate phase 30 is formed between the magnetic phase 10 and the Zn phase 20.

Figure 5:
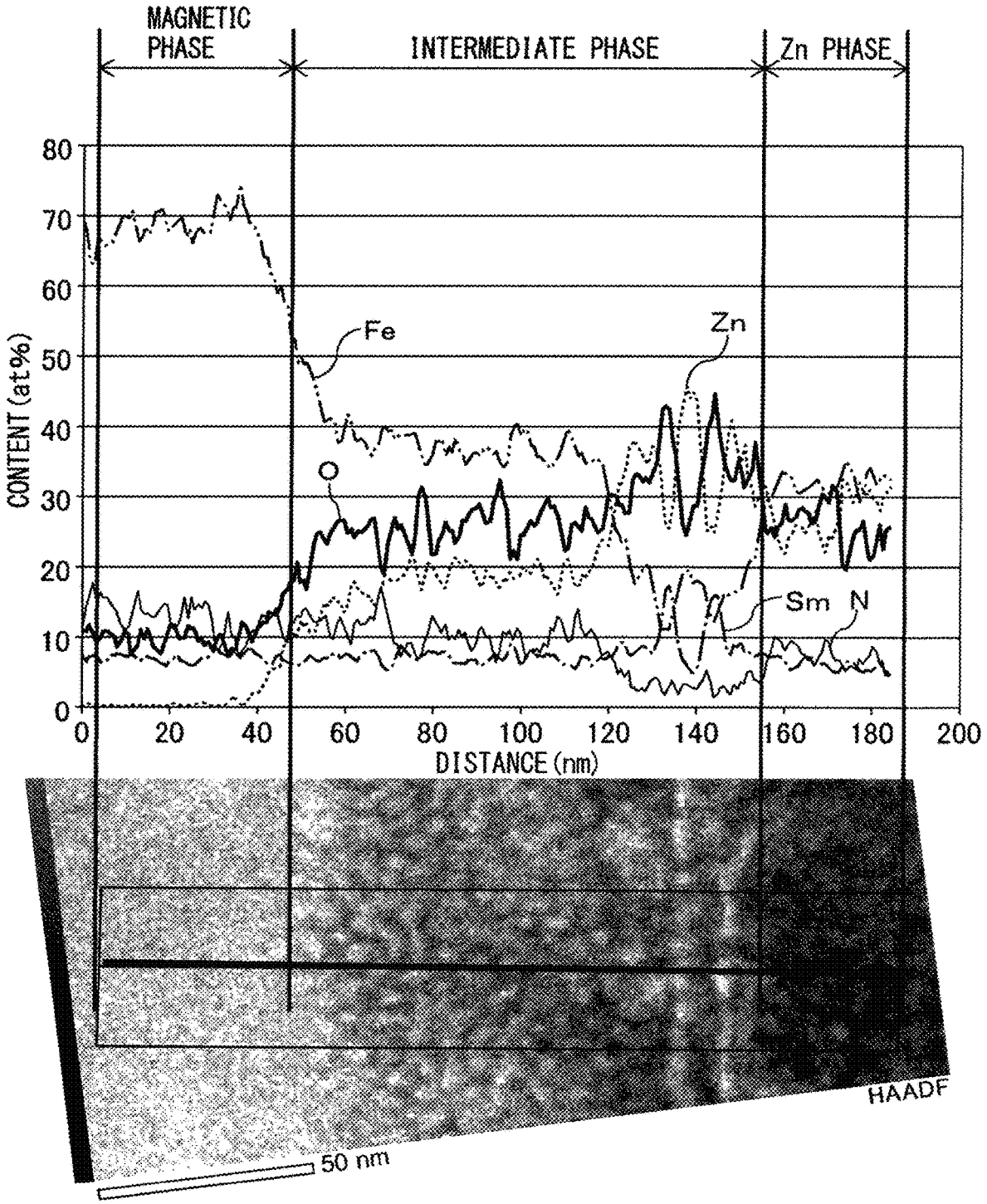
FIG. 5 is a diagram illustrating the results of, with respect to the sample of Example 5, analyzing the composition near the intermediate phase by EDX.

FIG. 5 is a diagram illustrating the results of, with respect to the sample of Example 5, analyzing the composition near the intermediate phase 30 by EDX. From FIG. 5, it could be confirmed that the oxygen content of the intermediate phase 30 is 1.5 times or higher than the oxygen content of the Zn phase 20.

In Tables 1 and 2, when the effects of the rare earth magnet of the present disclosure are recognized, the maximum value of the oxygen content of the magnetic raw material powder relative to the whole magnetic raw material powder is 1.5 mass %, and the minimum value of the oxygen content of the improving agent powder relative to the whole improving agent powder is 0.087 mass %. Furthermore, in FIG. 5, the oxygen content of the intermediate phase 30 rises from the magnetic phase 10 toward the Zn phase 20. These results suggest that the oxygen content of the intermediate phase 30 is 20 times (1.7/0.084) or less the oxygen content of the Zn phase 20

Figure 6:
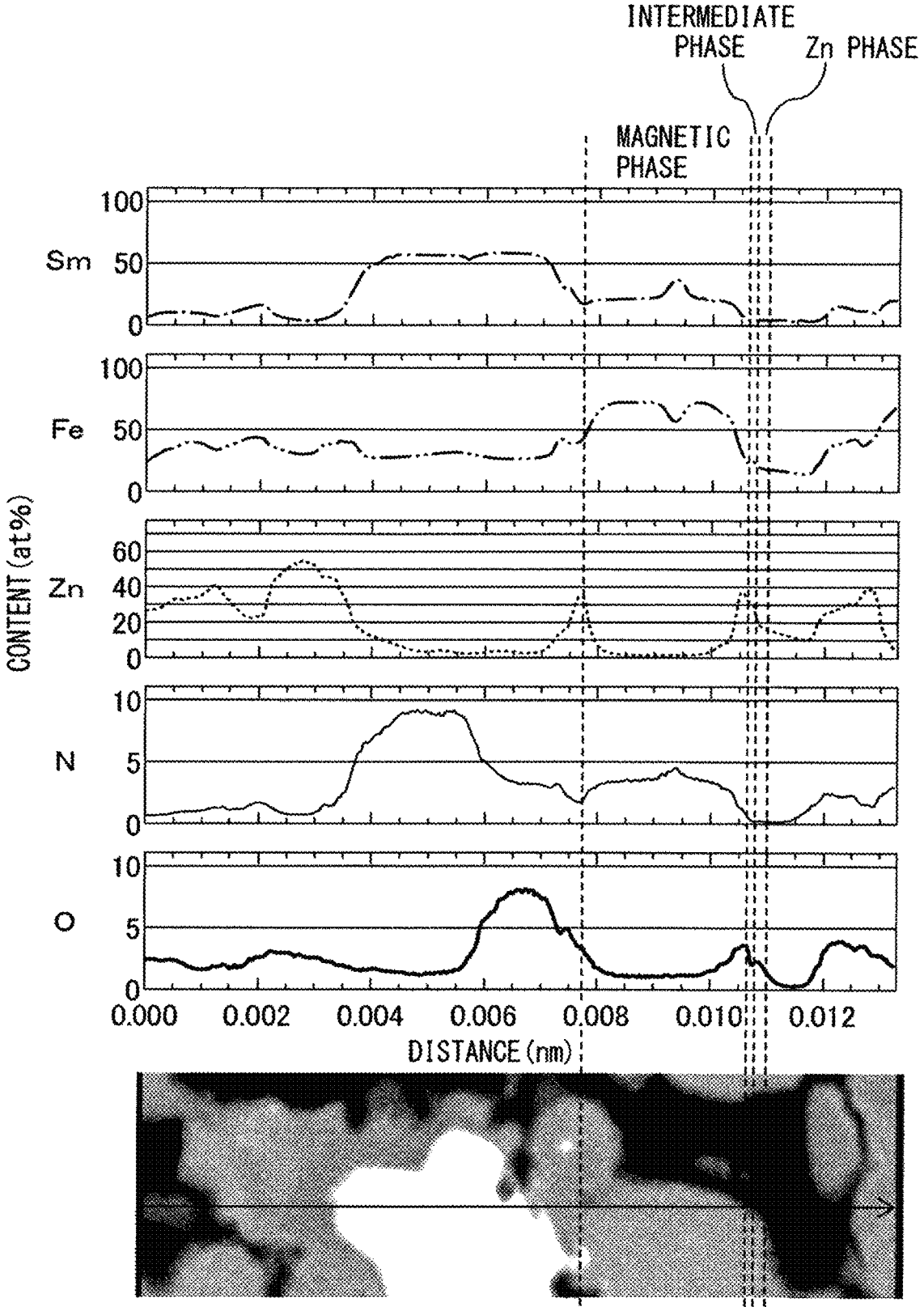
FIG. 6 is a diagram illustrating the results of, with respect to the sample of Example 5, analyzing the composition near the intermediate phase by EPMA.

FIG. 6 is a diagram illustrating the results of, with respect to the sample of Example 5, analyzing the composition near the intermediate phase by EPMA. As seen from FIG. 6, it could be confirmed that the same results as in FIG. 5 are obtained also in the EPMA analysis.

Figure 7:
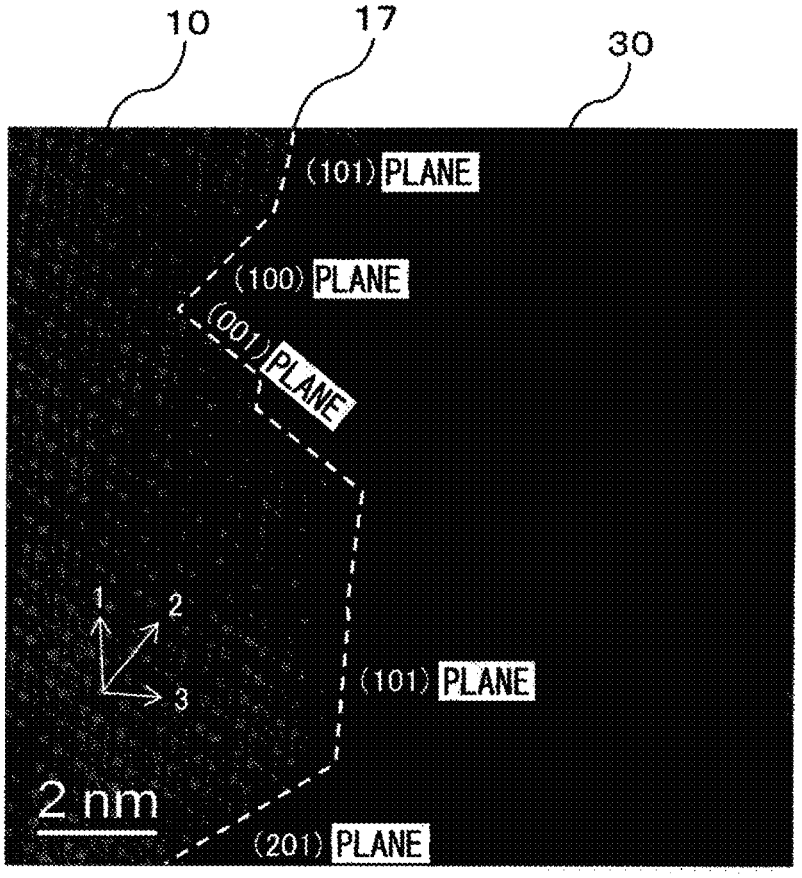
FIG. 7 is a diagram illustrating the results of, with respect to the sample of Example 5, observing the texture near the intermediate phase by using a high-angle annular dark-field scanning transmission electron microscope.

FIG. 7 is a diagram illustrating the results of, with respect to the sample of Example 5, observing the texture near the intermediate phase 30 by using a high-angle annular dark-field scanning transmission electron microscope. As seen from FIG. 7, it could be confirmed that a facet interface 17 is formed between the magnetic phase 10 and the intermediate phase 30. In addition, it could be confirmed that the facet interface is a low index plane of (101) plane, (100) plane, (101) plane, and (201) plane.

Figure 8A:
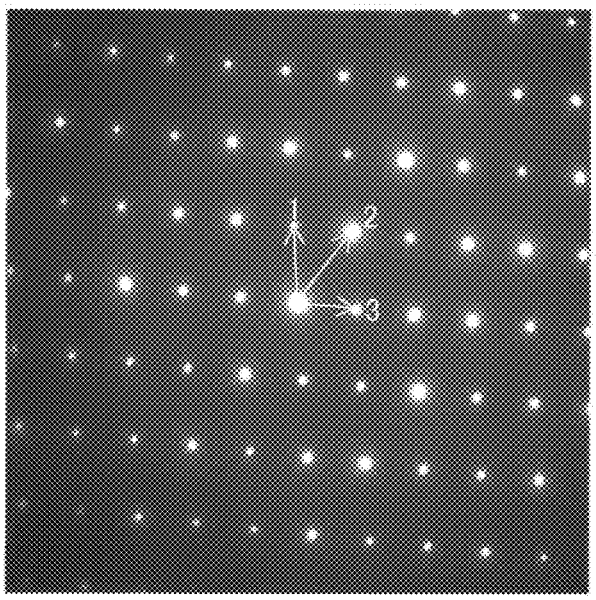
FIG. 8A is a diagram illustrating the results of, with respect to the sample of Example 5, measurement analysis of the electron beam diffraction pattern.
Figure 8B:
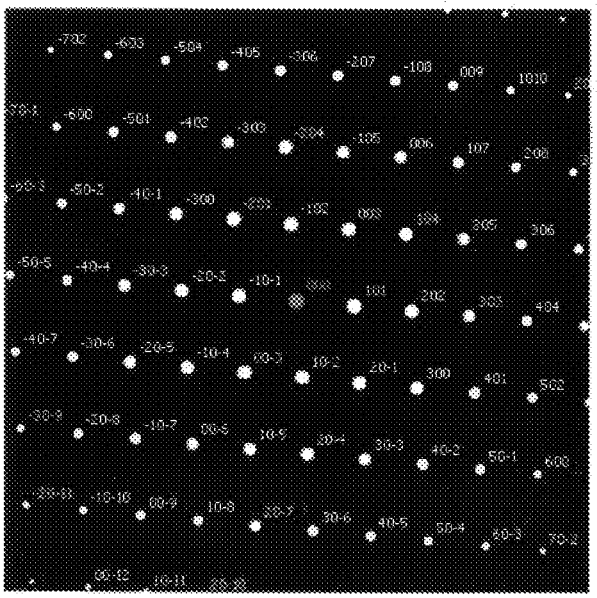
FIG. 8B is a diagram illustrating the results of, with respect to the sample of Example 5, numerical analysis of the electron beam diffraction pattern.

FIG. 8A is a diagram illustrating the results of, with respect to the sample of Example 5, measurement analysis of the electron beam diffraction pattern. FIG. 8B is a diagram illustrating the results of, with respect to the sample of Example 5, numerical analysis of the electron beam diffraction pattern. In Table 3, with respect to the directions indicated by 1, 2 and 3 in FIGS. 7, 8A, and 8B, $d_{hkl}$ obtained by the measurement and $d_{hkl}$ obtained by the numerical analysis are shown together. As seen from FIG. 7 and Table 3, it could be confirmed that a low index plane is formed.

TABLE 3

| | | $Sm_2Fe_{17}N_3$ | | |
|---|---|---|---|---|
| | Measured Value of $d_{hkl}$ (nm) | Calculated Value of $d_{hkl}$ (nm) | hkl | Zone Axis |
| 1 | 0.488 | 0.486 | −1 0 2 | 0 −1 0 |
| 2 | 0.424 | 0.422 | 0 0 3 | |
| 3 | 0.650 | 0.649 | 1 0 1 | |

Figure 9:
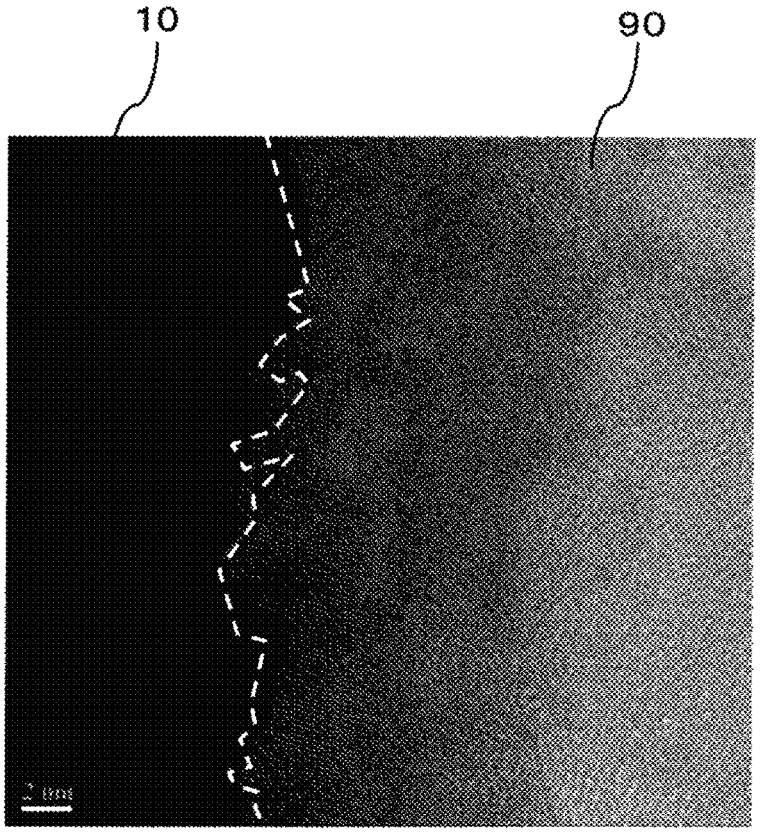
FIG. 9 is a diagram illustrating the results of, with respect to the magnetic raw material powder, observing the vicinity of the surface of the magnetic phase by using a scanning transmission electron microscope.

FIG. 9 is a diagram illustrating the results of, with respect to the magnetic raw material powder, observing the vicinity of the surface of the magnetic phase 10 by using a scanning transmission electron microscope. In FIG. 9, symbol 90 is an embedding resin for observing the vicinity of the surface of the magnetic phase 10. As illustrated in FIG. 9, a facet interface is not recognized on the surface of the magnetic phase 10 of the magnetic raw material powder. On the other hand, as illustrated in FIG. 7, a facet interface 17 is recognized in the sample (rare earth magnet) of Example 5. From these results, it could be confirmed that a facet interface 17 recognized in the sample of Example 5 is formed by heat-treating the mixed powder 50.

Figure 10:
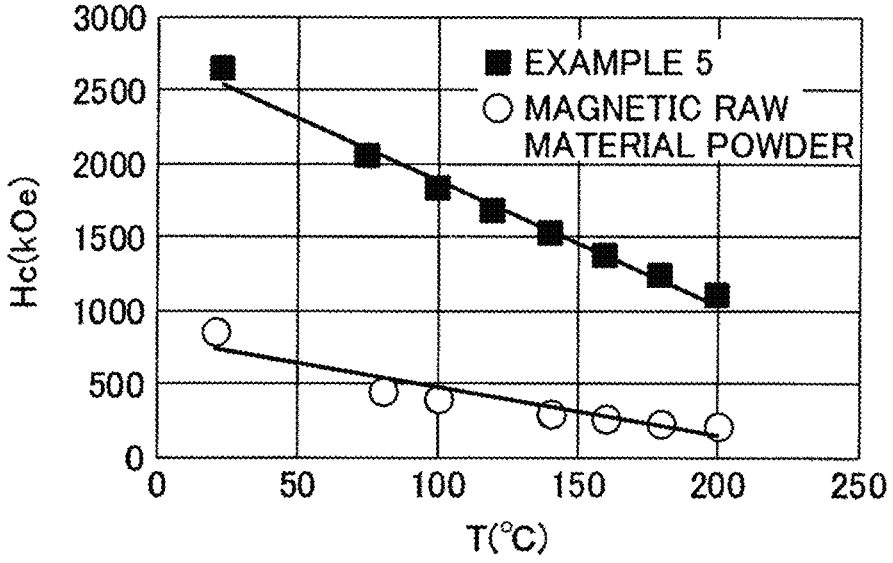
FIG. 10 is a graph illustrating the relationship between the temperature and the cohesive force with respect to the sample of Example 5 and the magnetic raw material powder.

FIG. 10 is a graph illustrating the relationship between the temperature and the cohesive force with respect to the sample of Example 5 and the magnetic raw material powder. As seen from FIG. 10, it could be confirmed that the coercive force has temperature dependency.

Figure 11:
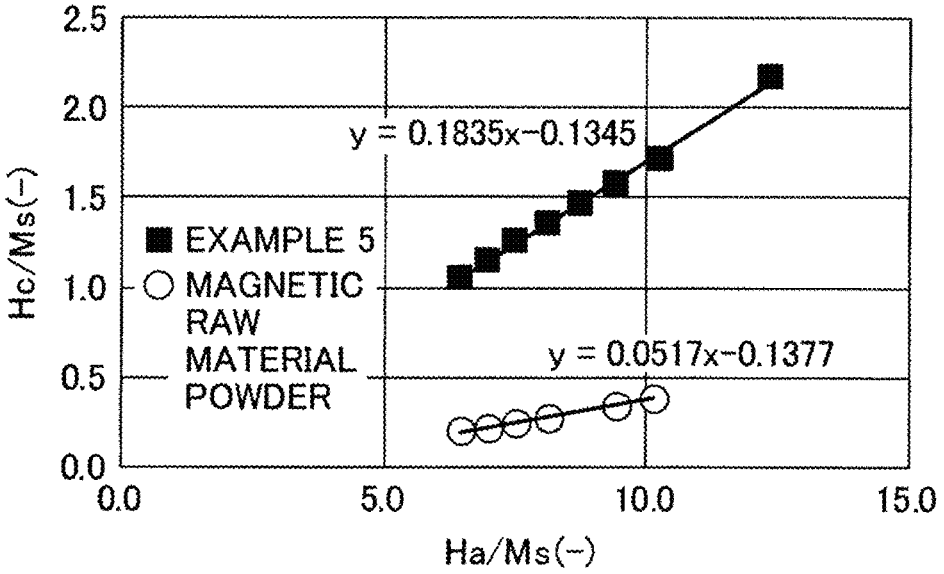
FIG. 11 is a graph illustrating the relationship between $H_a/M_s$ and $H_c/M_s$ with respect to the sample of Example 5 and the magnetic raw material powder.

FIG. 11 is a graph illustrating the relationship between $H_a/M_s$ and $H_c/M_s$ with respect to the sample of Example 5 and the magnetic raw material powder. Here, when both sides of Kronmuller formula are divided by $M_s$, $H_c/M_s=\alpha \cdot H_a/M_s-N_{eff}$ ($\alpha$ is the texture parameter, $H_c$ is the coercive force, $H_a$ is the anisotropic magnetic field, $M_s$ is the saturation magnetization, and $N_{eff}$ is the self-demagnetizing field coefficient) is established. Accordingly, in FIG. 11, the gradient is $\alpha$, and the y-intercept is $N_{eff}$.

As seen from FIG. 11, it could be confirmed that the texture parameter $\alpha$ is enhanced in the sample of Example 5 than in the magnetic raw material powder. In addition, $N_{eff}$ in the sample of Example 5 is not so much different from that in the magnetic raw material powder and therefore, it could be confirmed that there is not so much difference between the particle diameter of the magnetic phase 10 in the rare earth magnet 100 and the particle diameter of the magnetic phase in the magnetic raw material powder.

Figure 12:
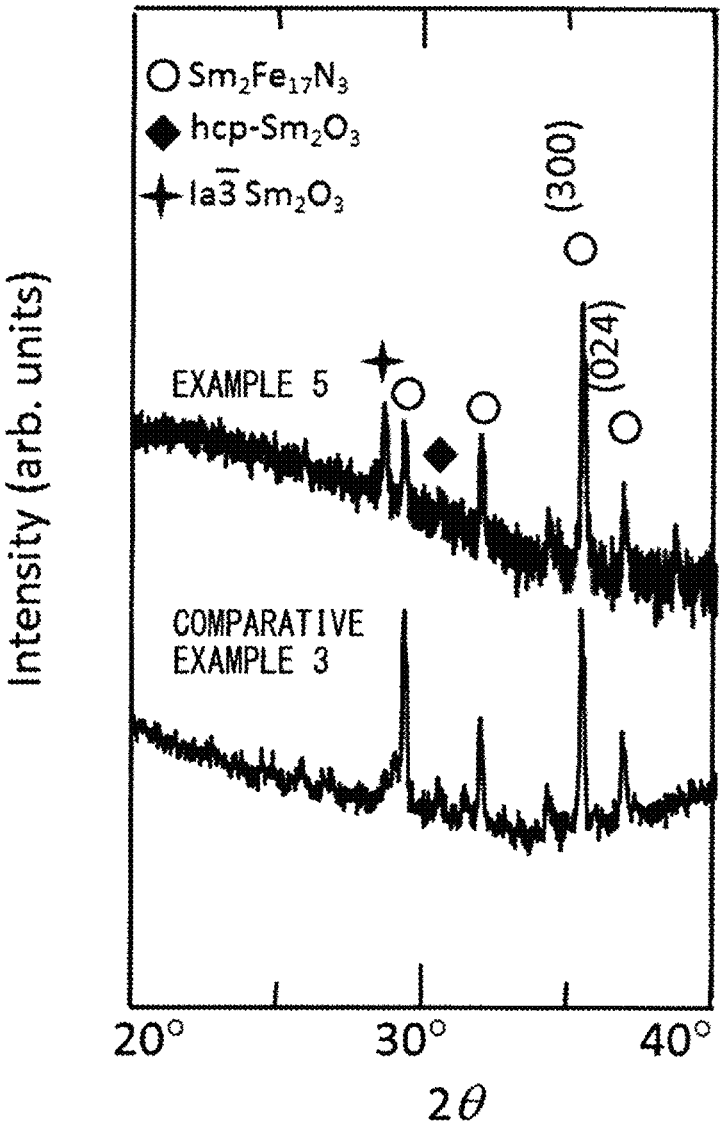
FIG. 12 is a diagram illustrating the results of X-ray diffraction (XRD) analysis with respect to the samples of Example 5 and Comparative Example 3.

FIG. 12 is a diagram illustrating the results of X-ray diffraction (XRD) analysis with respect to the samples of Example 5 and Comparative Example 3. As seen from FIG. 12, it could be confirmed that while hcp-type $Sm_2O_3$ is formed in Comparative Example 3, Ia-3-type $Sm_2O_3$ is formed in the sample of Example 5.

Figure 13:
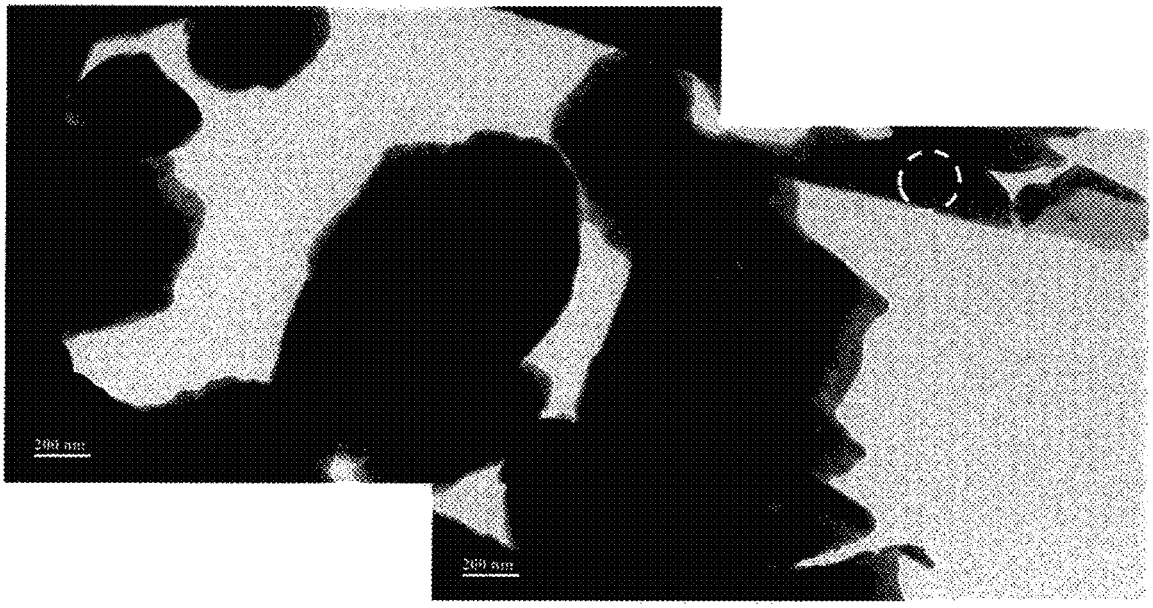
FIG. 13 is a diagram illustrating the results of, with respect to the sample of Example 5, observing the texture near the intermediate phase by using a transmission electron microscope.
Figure 14:
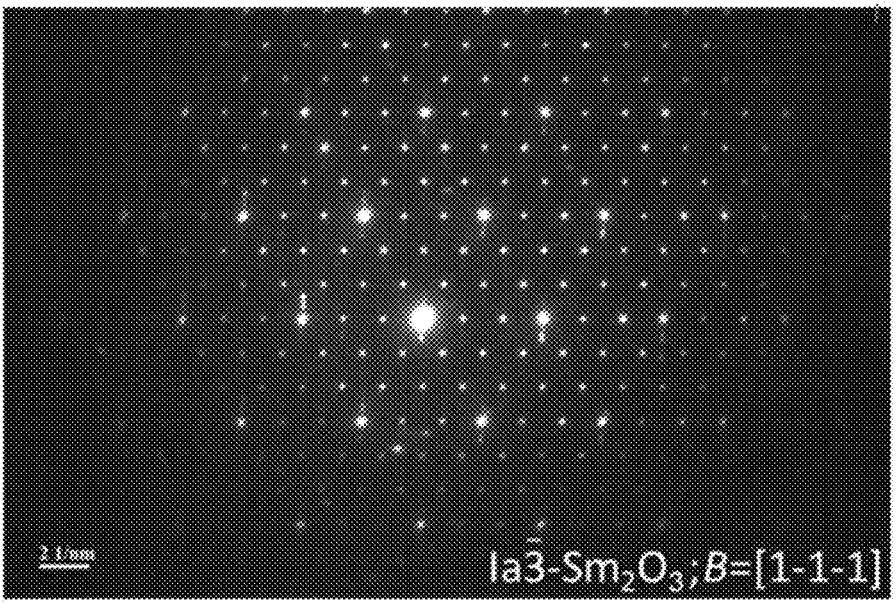
FIG. 14 is a diagram illustrating the results of electron bean diffraction analysis by using a transmission electron microscope with respect to the portion surrounded by a dashed line in FIG. 13.
Figure 14:
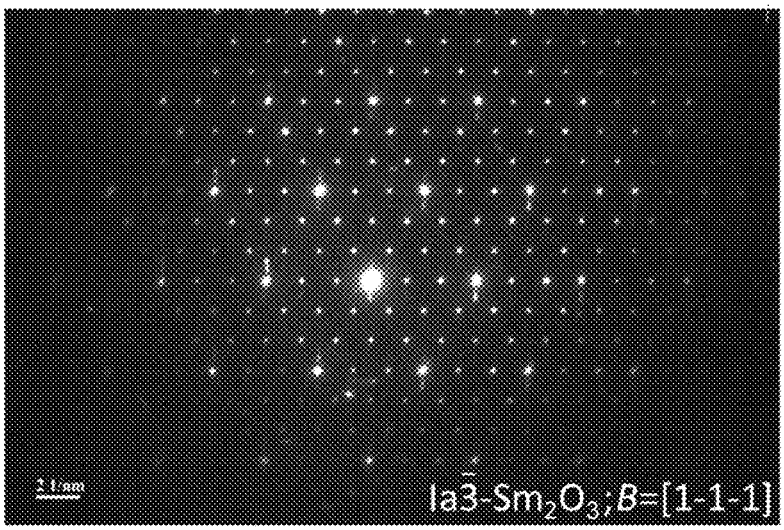

FIG. 13 is a diagram illustrating the results of, with respect to the sample of Example 5, observing the texture near the intermediate phase 30 by using a transmission electron microscope. FIG. 14 is a diagram illustrating the results of electron bean diffraction analysis by using a transmission electron microscope with respect to the portion surrounded by a dashed line in FIG. 13. As seen from FIGS. 13 and 14, it could be confirmed that the Ia-3-type $Sm_2O_3$ in the sample of Example 5 is formed in the intermediate phase 30.

Although not bound by theory, it is believed that in the sample of Example 5, the coercive force is enhanced by virtue of Ia-3-type $Sm_2O_3$.

The evaluation results of Examples 9 to 14 are shown in Table 4. In Table 4, the results of measurement of the coercive force at 160° C. are shown together. In addition, the relationship between the texture parameter $\alpha$ and the cohesive force (160° C.) is illustrated in FIG. 18 by combining the results in Table 4.

TABLE 4

| | Oxygen Content of Magnetic Raw Material Powder (mass %) | Oxygen Content of Improving Agent Powder (mass %) | Amount of Zn Component in Improving Agent Powder (mass %) | Average Particle Diameter of Improving Agent Powder (μm) | Sintering Temperature (° C.) | Coercive Force (kA/m) Room Temperature | Coercive Force (kA/m) 160° C. | Residual Magnetization (T) | α | Oxygen Content of Rare Earth Magnet (after sintering) (mass %) |
|---|---|---|---|---|---|---|---|---|---|---|
| Example 9 | 1.05 | 0.032 | 5 | 20 | 475 | 1193 | 617 | 0.59 | 0.093 | 1.002 |
| Example 10 | 1.05 | 0.032 | 5 | 20 | 450 | 946 | 435 | 0.60 | 0.071 | 1.002 |
| Example 11 | 1.05 | 0.032 | 15 | 20 | 450 | 1484 | 781 | 0.53 | 0.113 | 0.917 |
| Example 12 | 1.70 | 0.032 | 10 | 20 | 475 | 1114 | 545 | 0.81 | 0.085 | 1.548 |
| Example 13 | 1.34 | 0.009 | 15 | 65 | 450 | 1194 | 601 | 0.40 | 0.090 | 1.166 |
| Example 14 | 1.05 | 0.032 | 15 | 20 | 475 | 1639 | 835 | 0.49 | 0.120 | 0.913 |

Figure 18:
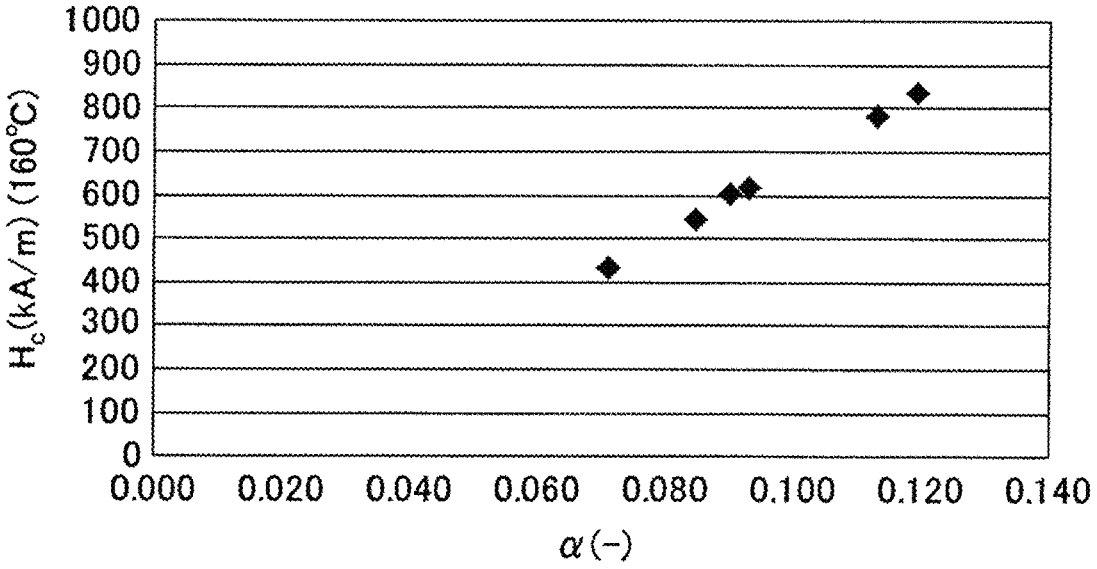
FIG. 18 is a graph illustrating the relationship between the texture parameter α and the cohesive force (160° C.) with respect to the samples of Examples 9 to 14.

As seen from Table 4 and FIG. 18, it could be confirmed that when the α value is 0.090 or more, a coercive force of 550 A/m or more can be obtained even at high temperature (160° C.).

Figure 17A:
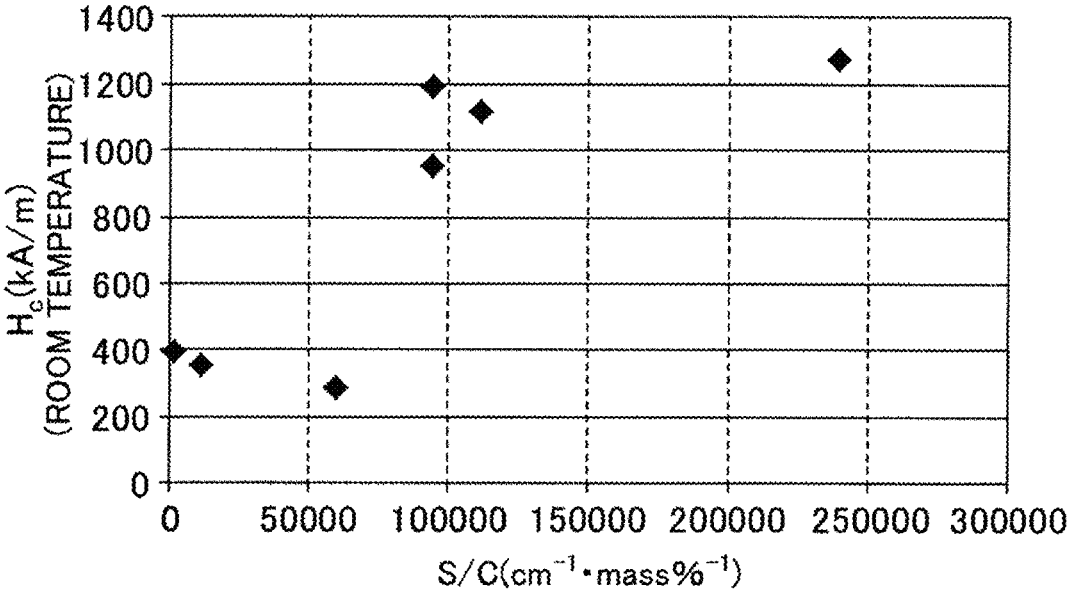
FIG. 17A is a graph illustrating the relationship between S/C and the cohesive force (room temperature) with respect to the samples of Examples 15 to 18 and Comparative Examples 6 to 8.
Figure 17B:
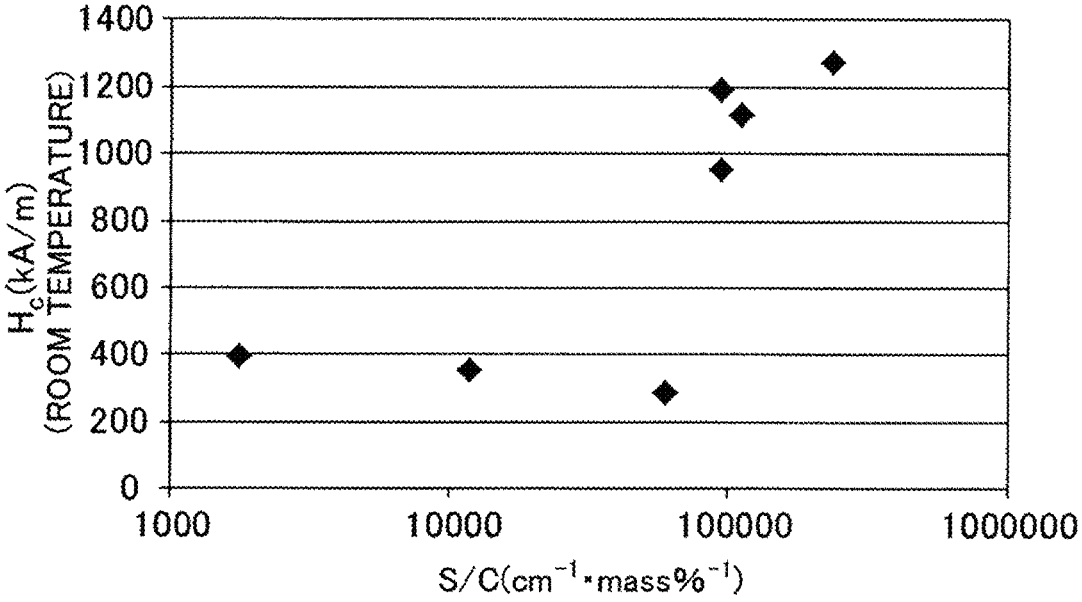
FIG. 17B expresses S/C of FIG. 17A on a logarithmic scale.

Evaluation results of Examples 15 to 18 and Comparative Examples 6 to 8 are shown in Table 5. In Table 5, the particle diameter of the improving agent powder and the value of S/C are shown together. In addition, the relationship between S/C and the coercive force (room temperature) is illustrated in FIG. 17A by combining the results in Table 5. In FIG. 17B, S/C of FIG. 17A is expressed on a logarithmic scale.

TABLE 5

| | Oxygen Content of Magnetic Raw Material Powder (mass %) | Oxygen Content of Improving Agent Powder (mass %) | Amount of Zn Component in Improving Agent Powder (mass %) | Average Particle Diameter of Improving Agent Powder (μm) | S/C ($cm^{-1}$ · mass $\%^{-1}$) | Sintering Temperature (° C.) | Coercive Force (kA/m) | Residual Magnetization (T) | α | Oxygen Content of Rare Earth Magnet (after sintering) (mass %) |
|---|---|---|---|---|---|---|---|---|---|---|
| Example 15 | 1.34 | 0.032 | 5 | 20 | 93750 | 475 | 955 | 0.91 | 0.074 | 1.27 |
| Example 16 | 1.34 | 0.032 | 10 | 20 | 93750 | 475 | 1194 | 0.82 | 0.090 | 1.21 |
| Example 17 | 1.34 | 0.009 | 10 | 60 | 111111 | 475 | 1114 | 0.81 | 0.085 | 1.21 |
| Example 18 | 1.34 | 0.050 | 10 | 5 | 240000 | 475 | 1273 | 0.80 | 0.095 | 1.21 |
| Comparative Example 6 | 1.34 | 9.900 | 5 | 3.4 | 1777 | 475 | 398 | 0.89 | 0.037 | 1.77 |
| Comparative Example 7 | 1.34 | 1.530 | 5 | 3.3 | 11920 | 475 | 358 | 0.91 | 0.035 | 1.35 |
| Comparative Example 8 | 1.34 | 0.001 | 10 | 1000 | 60000 | 475 | 286 | 0.82 | 0.030 | 1.21 |

As seen from Table 5 and FIGS. 17A and 17B, it was found that when S/C is 90,000 or more, the coercive force surpasses the coercive force (857 kA/m) of the magnetic raw material powder.

Figure 19A:
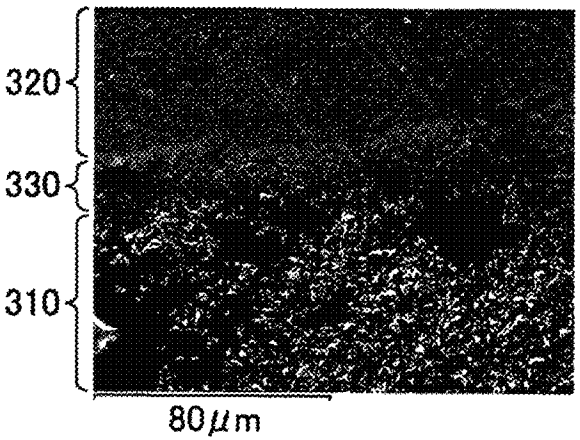
FIG. 19A is a diagram illustrating a scanning electron microscope image of Comparative Example 8.
Figure 19B:
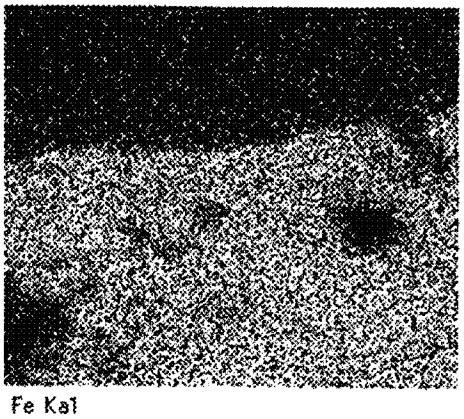
FIG. 19B FIG. 19B is a diagram illustrating the results of Fe area analysis on the image of FIG. 19A.
Figure 19C:
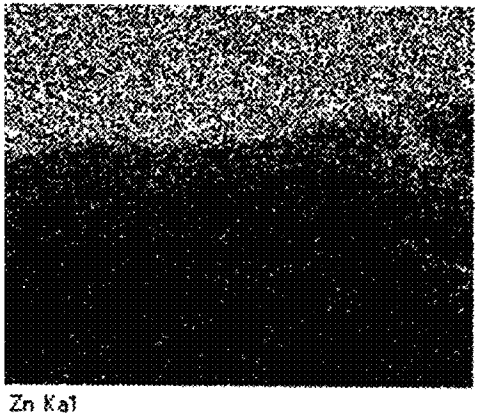
FIG. 19C is a diagram illustrating the results of Zn area analysis on the image of FIG. 19A.

FIGS. 19A, 19B, and 19C are diagrams illustrating the results of, with respect to the sample of Comparative Example 8, observing the texture near the interface between the magnetic phase 10 and the Zn phase 20 by using a scanning electron microscope. FIG. 19A illustrates a scanning electron microscope image of Comparative Example 8, FIG. 19B illustrates the results of Fe area analysis (Fe mapping) on the image of FIG. 19A, and FIG. 19C illustrates the results of Zn area analysis (Zn mapping) on the image of FIG. 19A. In FIG. 19B, the portion displayed bright indicates that the Fe concentration is high. In FIG. 19C, the portion displayed bright indicates that the Zn concentration is high.

A region 310 in which particles gather is recognized in the lower part of FIG. 19A, and from FIG. 19B, it is recognized that the aggregate contains a large amount of Fe. From these facts, the region 310 can be said to be a region in which the magnetic raw material powder ($Sm_2Fe_{17}N_3$) gathers as it is.

On the other hand, a region in which a bulky mass exists is recognized in the upper part of FIG. 19A, and from FIG. 19C, it is recognized that the bulky mass contains a large amount of Zn. From these facts, the region 320 can be said to be a region in which Zn of the improving agent powder is melted and solidified.

In addition, a region in which a particle and a bulky mass are mixed is recognized between the region 310 and the region 320. This region is believed to be exist because in the sample of Comparative Example 8, the particles diameter of the improving agent powder is significantly large compared with the particle diameter of the magnetic raw material powder and therefore, the surface of a magnetic phase 10 derived from the magnetic raw material powder was not sufficiently coated with a Zn phase derived from the improving agent powder, as a result, an intermediate phase 30 as in FIG. 1 was not formed, allowing a molten improving agent powder to penetrate between particles of the magnetic raw material powder.

Furthermore, in Comparative Example 8, since the whole sample is in the state illustrated in FIG. 19A, as shown in Table 5, the texture parameter α of the sample of Comparative Example 8 is very small and in turn, the coercive force is also small.

The effects of the rare earth magnet of the present disclosure and the production method thereof could be confirmed from these results.

DESCRIPTION OF NUMERICAL REFERENCES

10 Magnetic phase
12 α-Fe phase
14 Unmatched interface
16 Interface
15 Oxidized phase
20 Zn phase
30 Intermediate phase
50 Particle of mixed powder
90 Embedding resin
100 Rare earth magnet of the present disclosure
110 Agitating drum
120 Material storing part
130 Rotary shaft
150 Magnetic raw material powder
160 Improving agent powder
170 Melt
200 Arc plasma deposition apparatus
210 Arc plasma gun
220 Particles
230 Stage
310 Particle gathering region
320 Bulky mass region
330 Mixed region

What is claimed is:

1. A rare earth magnet comprising:
a magnetic phase containing Sm, Fe, and N,
a Zn phase present around the magnetic phase, and
an intermediate phase present between the magnetic phase and the Zn phase, the intermediate phase containing Zn,
wherein:
an oxygen content of the intermediate phase is from 2.2 to 20.0 times higher than an oxygen content of the Zn phase, and
an oxygen content of the whole rare earth magnet is from 2.00 to 3.00 mass %.

2. The rare earth magnet according to claim 1, wherein an $Sm_2O_3$ phase having an Ia-3 crystal structure is formed in the intermediate phase.

3. The rare earth magnet according to claim 1, wherein the magnetic phase contains a phase represented by $(Sm_{(1-i)}R_1)_2(Fe_{(1-j)}Co_j)_{17}N_h$, wherein R is one or more members selected from rare earth elements other than Sm, and Y and Zr, i is from 0 to 0.50, j is from 0 to 0.52, and h is from 1.5 to 4.5.

4. The rare earth magnet according to claim 1, wherein a texture parameter α is represented by the formula: $H_c=\alpha\cdot H_a-N_{eff}\cdot M_s$, in which
$H_c$ is the coercive force,
$H_a$ is the anisotropic magnetic field,
$M_s$ is the saturation magnetization,
$N_{eff}$ is the self-demagnetizing field coefficient, and
the texture parameter α is from 0.07 to 0.55.

5. The rare earth magnet according to claim 4, wherein the texture parameter α is from 0.11 to 0.55.

6. The rare earth magnet according to claim 4, wherein the oxygen content of the intermediate phase is from 8.6 to 20.0 times higher than the oxygen content of the Zn phase.

7. A method for producing the rare earth element according to claim 1, the method comprising:
mixing a magnetic raw material powder containing Sm, Fe, and N with an improving agent powder containing at least either one of metallic Zn and a Zn alloy such that the content of a Zn component in the improving agent powder is from 1 to 20 mass % relative to the total of the magnetic raw material powder and the improving agent powder, thereby obtaining a mixed powder, and
heat-treating the mixed powder at T−30° C. or more and 500° C. or less, denoting T° C. as the lowest melting point out of the melting points of the metallic Zn or Zn alloy contained in the mixed powder,
wherein the oxygen content in the improving agent powder is 1.0 mass % or less relative to the whole improving agent powder.

8. The method according to claim 7, wherein the magnetic raw material powder contains a magnetic phase represented by $(Sm_{(1-i)}R_i)_2(Fe_{(1-j)}Co_j)_{17}N_h$ (wherein R is one or more members selected from rare earth elements other than Sm, and Y and Zr, i is from 0 to 0.50, j is from 0 to 0.52, and h is from 1.5 to 4.5).

9. The method according to claim 7, wherein the mixing and heat treatment are performed at the same time.

10. The method according to claim 7, further comprising compacting the mixed powder before the heat treatment.

11. The method according to claim 10, wherein the compacting is performed in a magnetic field.

12. The method according to claim 7, wherein with respect to a unit particle of the improving agent powder, denoting C (mass %) as the oxygen content and denoting S ($cm^{-1}$) as the ratio of the surface area to the volume, the value of S/C ($cm^{-1}$·mass $\%^{-1}$) is 90,000 or more.

13. The rare earth magnet according to claim 1, wherein the oxygen content of the intermediate phase is from 8.6 to 20.0 times higher than the oxygen content of the Zn phase.

14. The rare earth magnet according to claim 1, wherein the oxygen content of the whole rare earth magnet is from 2.25 to 3.00 mass %.

15. A rare earth magnet comprising:

a magnetic phase containing Sm, Fe, and N, a Zn phase present around the magnetic phase, and an intermediate phase present between the magnetic phase and the Zn phase, the intermediate phase containing Zn, wherein:

an oxygen content of the intermediate phase is from 2.2 to 20.0 times higher than an oxygen content of the Zn phase, and an oxygen content of the whole rare earth magnet is from 1.55 to 3.00 mass %, the rare earth magnet having a composition represented by $Sm_xR_y Fe_{(100-x-y-z-w-p-q)}Co_zM^1_wN_pO_q\cdot(Zn_{(1-s-t)}M^2_sO_t)_r$, wherein:

R is one or more members selected from rare earth elements other than Sm, Y, and Zr, $M^1$ represents one or more members selected from Ga, Ti, Cr, Zn, Mn, V, Mo, W, Si, Re, Cu, Al, Ca, B, Ni, and C, and unavoidable impurity elements, $M^2$ represents one or more members selected from Sn, Mg, and Al, and unavoidable impurity elements, x, y, z, w, p, q, and r are at %, s and t are a molar ratio, and s is non-zero.

* * * * *